US006105178A

United States Patent [19]

Kurisaki et al.

[11] Patent Number: 6,105,178

[45] **Date of Patent: *Aug. 22, 2000**

[54] SANITARY CLEANSING APPARATUS

[75] Inventors: Toshio Kurisaki; Eiji Kitamoto; Yasushi Imma, all of Kitakyushu, Japan

[73] Assignee: Toto Ltd., Kitakyushu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/894,499

[22] PCT Filed: Feb. 22, 1996

[86] PCT No.: PCT/JP96/00415

§ 371 Date: Aug. 19, 1997

§ 102(e) Date: Aug. 19, 1997

[87] PCT Pub. No.: WO96/27054

PCT Pub. Date: Sep. 6, 1996

[30] Foreign Application Priority Data

Feb. 28, 1995 [JP] Japan ..... 7-066783

[51] Int. Cl.[7] ..... A47K 3/20

[52] U.S. Cl. ..... 4/420.4; 4/443; 4/444

[58] Field of Search ..... 4/420.4, 420.5, 4/443, 444, 445, 446, 447, 448

[56] References Cited

U.S. PATENT DOCUMENTS

| | | | |
|---|---|---|---|
| 4,987,617 | 1/1991 | Furukawa et al. | 4/443 |
| 5,201,080 | 4/1993 | Tanaka et al. | 4/443 |

FOREIGN PATENT DOCUMENTS

| | | |
|---|---|---|
| 0 195 842 | 1/1986 | European Pat. Off. . |
| 02261138 | 10/1990 | Japan . |

*Primary Examiner*—David J. Walczak
*Attorney, Agent, or Firm*—Beyer Weaver Thomas & Nguyen, LLP

[57] ABSTRACT

Sanitary cleansing apparatus 20 is provided with attachment state sensor 180 for detecting the state of attachment to toilet bowl 21. When OFF signal is output from attachment state sensor 180, first closing valve 137*a* is closed at step S82 and power supply to cleansing water heater 129 is stopped at step S84; shower nozzle 24 is finally stored in standby position. Therefore, troubles are fairly prevented since shower nozzle 24 is stored in standby position with inhibition of water spouting function when sanitary cleansing apparatus 20 is detached from toilet bowl 21.

25 Claims, 20 Drawing Sheets

SANITARY CLEANSING APPARATUS

TECHNICAL FIELD

The present invention relates to a sanitary cleansing apparatus detachable from the toilet bowl.

DESCRIPTION OF THE PRIOR ART

A sanitary cleansing apparatus has been conventionally mounted on a base plate securely fixed to the upper rear part of a toilet bowl to spout cleansing water toward the excretory parts of a human body. In this type of sanitary cleansing apparatus, if filthy water or urine comes into narrow parts between the base plate and the cleansing apparatus or around the cleansing apparatus, the dirt tends to remain in those parts since they are difficult to be cleaned. As a solution to such a problem as above, a structure which facilitates removal of the dirt by making the sanitary cleansing apparatus detachable from the toilet bowl has been proposed.

Since the sanitary cleansing apparatus is mounted with an electrically or mechanically complicated mechanism thereon for such a purpose as spouting of cleansing water, it is requested that no troubles are caused in the mechanism at detachment from the toilet bowl.

SUMMARY OF THE INVENTION

The objective of the present invention is to solve the above-described technical problem by providing a sanitary cleansing apparatus wherein causes of the troubles at attaching to and detaching from the toilet bowl.

The present invention is directed to a sanitary cleansing apparatus which includes a case main body that is detachable from a toilet bowl and a sanitary cleansing means that is mounted on the case main body. The sanitary cleansing means is configured to execute sanitary cleansing processes that includes at least one of cleansing and drying of the excretory parts of the human body. The sanitary cleansing apparatus includes an operating means adapted to output of operational commands, and a sanitary cleansing commanding means outputting commands on proceeding of the sanitary cleansing processes based on the operational commands that are outputs from the operating means to the sanitary cleansing means. An attachment state of detection means is provided to detect a state of attachment of the sanitary cleansing apparatus between an attached state, attached to the toilet bowl, and a detached state, detached from the toilet bowl. The sanitary cleansing apparatus further includes an inhibiting means configured to inhibit the sanitary cleansing means from the sanitary cleansing processes when the sanitary cleansing apparatus is detected to be in the detached state by the attachment state detection means.

The sanitary cleansing means related to the present invention performs such functions as cleansing and drying of the excretory parts of the human body under the control of the sanitary cleansing commanding means on reception of the operational commands from the operating means. The sanitary cleansing apparatus with the sanitary cleansing means mounted thereon is detachable from the toilet bowl and thus cleaning and other operations are facilitate with detachment from the toilet bowl. When the sanitary cleansing apparatus is detached from the toilet bowl, the attachment state means outputs the information to the inhibiting means. On receiving the information, the inhibiting means inhibits the sanitary cleansing commanding means from commanding the sanitary cleansing function unit to proceed the sanitary cleansing processes. Therefore, even if the operating means is pressed to operate when the sanitary cleansing apparatus is detached from the toilet bowl, the sanitary cleansing means is inhibited from being activated.

The attachment state detection means may be a means for detecting a transient state of attaching or detaching operation of the toilet bowl and the sanitary cleansing apparatus as well as the means for detecting the fully attached or detached state of the toilet bowl and the sanitary cleansing apparatus.

A preferable mode of the attachment state detection means shall have a structure wherein an attachment state determination part determines the state as attached or detached not immediately on receiving an attachment state signal from an attachment state signal output part but after continually receiving the attachment state signal. Based on the determination, either inhibition of the command transmission to the sanitary cleansing means or cancellation of the inhibition command is executed. Therefore, even if the signal from the attachment state detection means may become unstable after attachment or detachment of the sanitary cleansing apparatus has taken time, the sanitary cleansing means will not give the sanitary cleansing process inhibition command and the inhibition cancellation command in a frequently alternating repetition.

A mode of the sanitary cleansing function unit may have a structure of a standby-and-transition-inclusive function unit wherein a transition from a standby state to a cleansing state is executed with a sanitary cleansing process command from the sanitary cleansing commanding means. In this structure, on reception of the information on the detached state from the attachment state detection means, the inhibition means gives the sanitary cleansing commanding means a command of transition of the standby-and-transition-inclusive function unit to the standby state and then inhibits the sanitary cleansing processes. Therefore, when the sanitary cleansing apparatus is detached from the toilet bowl, no troubles are caused since transition of the standby-and-transition-inclusive function unit to the standby state is immediately executed.

An embodiment of the standby-and-transition-inclusive function unit may be an application to a shower nozzle. After the shower nozzle is stored in the standby state, the sanitary cleansing means is inhibited from the sanitary cleansing processes. Therefore, during cleaning with the sanitary cleansing apparatus detached, no troubles will be caused by such a load as applied on the shower nozzle when the shower nozzle comes into contact with the floor.

An alternative embodiment of the standby-and-transition-inclusive function unit may be an application to a heating means which sends heat from a heater by a fan; in such a structure as the fan is stopped with some delay by a delay means after power supply to the heater is shut off when the detached state is detected by the attachment state detection means, no troubles will be caused in peripheral areas of the heater by remaining heat since the parts heated while power is supplied is cooled by the fan.

The inhibiting means may have, in stead of a structure wherein all the sanitary cleansing processes of the sanitary cleansing means are inhibited, a structure wherein some processes are inhibited; for example, a structure wherein a function of transition of the shower nozzle to the standby state may is refrained from being inhibited by a manual operation when the sanitary cleansing apparatus is in the detached state.

An alternative mode of the sanitary cleansing function unit may have a structure of a hot water shutoff means which comprises a hot water shutoff function to inhibit spouting of hot water determined as an abnormality when the temperature of cleansing water flowing through a spout water conduit is higher than a predetermined temperature. In this case, the inhibiting means may have a structure of hot water shutoff lock means for locking the hot water shutoff function of the hot water shutoff means. That is, in the detached state, hot water will not be determined as an abnormality even if the temperature of cleansing water flowing through the spout water conduit is higher than the predetermined temperature. Therefore, since the hot water shutoff function will not be activated even if hot water may flow into the water conduit from a tilted cleansing water tan□k when the sanitary cleansing apparatus is detached from the toilet bowl, the sanitary cleansing processes are immediately available without continuing a water spouting inhibition command from the hot water shutoff means when the sanitary cleansing apparatus is attached to the toilet bowl.

Another alternative mode of the sanitary cleansing means may have a structure including a cleansing water tank wherein heated cleansing water is stored, and a spout water conduit which is connected to the cleansing water tank. A shower nozzle may be provided for spouting cleansing water from the cleansing water tank via the spout water conduit, and an intake air duct which is connected to the spout water conduit and which opens the spout water conduit to the atmospheric air. The cleansing means further includes a vacuum breaker for preventing counterflow from the shower nozzle to aid cleansing water tank. This may be performed by valve operations between an open valve position to open the intake air duct to the atmospheric air and a closed valve position to close the intake air duct while the cleansing water is flowing from the cleansing water tank. The inhibiting means further includes a closing valve to open and close the intake air duct and a closing valve control means for forcibly closing the closing valve when the detached state is detected by the attachment state detection means.

In this structure, the cleansing water stored in the cleansing water tank is spout from the shower nozzle toward the excretory parts of the human body via the spout water conduit. Said spout water conduit is connected to the vacuum breaker via the intake air duct. The vacuum breaker is closed by the supply water pressure applied when the cleansing water is spouted but, when the supply water pressure is not applied, the spout water channel is opened to the atmospheric air to prevent the counterflow from the shower nozzle to the cleansing water tank.

Since the vacuum breaker is open to the atmospheric air when supply water pressure is not applied, it is necessary to prevent leakage of the cleansing water from the cleansing water tank through the spout water conduit to the outside via the intake air duct when the sanitary cleansing apparatus is tilted after being detached from the toilet bowl. This is prevented by a means consisting of the closing valve and the closing valve control means. That is, the closing valve control means forcibly closes the closing valve when the attachment state detection means detects the detached state to prevent the heated water from leaking outside.

Still another alternative mode of the invention may have a cancellation means. Since the cancellation means cancels the inhibition command given by the inhibiting means when the sanitary cleansing apparatus is attached to the toilet bowl, the operating means needs not any operations for the cancellation. A preferable mode of the cancellation means may have a structure wherein a flow control valve is reset to a state of spouting at a desired flow rate. This is to prepare for the next sanitary, and thus the sanitary cleansing processes can be proceeded immediately when the sanitary cleansing apparatus is attached to the toilet bowl.

Another alternative mode of the cancellation means may have a structure wherein the inhibition command for the sanitary cleansing means is canceled in two steps. This mode of cancellation means is preferable to the sanitary cleansing means with a large rise time. That is, the cancellation means gives priority to resetting of the sanitary cleansing function unit with a large rise time at the first step so as to make the sanitary cleansing apparatus available immediately after coming to the attached state while causes for the troubles in the sanitary cleansing means to be reset at the second step are reduced. For example, since it takes time of some duration to heat the cleansing water by the water temperature control means, cancellation of the inhibition command for this water temperature control means with priority enables spouting of cleansing water heated to an appropriate temperature immediately after the sanitary cleansing apparatus is attached to the toilet bowl.

Still another alternative mode of the invention is direction to the sanitary cleansing apparatus which comprises a case main body that is detachable from the toilet bowl and a sanitary cleansing means that is mounted on the includes at least one of cleansing and drying of the excretory parts of the human body on transition from a standby state to a cleansing state. The sanitary cleansing apparatus includes an operating means adapted to output of operational commands, and a sanitary cleansing commanding means outputting commands on proceeding of the sanitary cleansing processes based on the operational commands that are outputs from the operating means to the sanitary cleansing means. An attachment state detection means is provided for detecting either a transient detached state, wherein the sanitary cleansing apparatus is on a process of detachment from the toilet bowl, or a detached state. The cleansing apparatus further includes a standby state commanding means for outputting a command to shift the sanitary cleansing means from the cleansing state to the standby state when one of the transient detached state and the detached state is detected by the attachment state detection means.

In this structure, on detection of either the transient detached state wherein the sanitary cleansing apparatus is on a process of detachment from the toilet bowl or the detached state; the attachment state detection means transmits the information to the standby state commanding means. On receiving the information, the standby state commanding means transmits to the sanitary cleansing commanding means a command of shifting the sanitary cleansing means to the standby state. Therefore, since the sanitary cleansing means will not be halted in the cleansing state when the sanitary cleansing apparatus is detached or being detached from the toilet bowl, troubles will not result from this operation.

Still another alternative mode of the invention is direction to the sanitary cleansing apparatus which includes a case main body that is detachable from a toilet bowl and a sanitary cleansing means that is mounted on the case main body to perform sanitary cleansing processes that include at least one of cleansing and drying of the excretory parts of the human body. The sanitary cleansing apparatus includes an attachment state of detection means for detecting a state of attachment of the sanitary cleansing apparatus between an attached state, attached to the toilet bowl, and a detached state, detached from the toilet bowl. A data setting means is provided for setting sanitary cleansing data for the sanitary cleansing means including cleansing water temperature and drying air temperature. The cleansing apparatus further includes a sanitary cleansing data storing means which includes a non-volatile memory unit for storing data even at a non-energized time. The storing means further provides a memory command unit for making the non-volatile memory unit store the sanitary cleansing data set by the data setting means when the detached state is detected by the attachment state detection means.

In this structure, the memory commanding unit of the sanitary cleansing data storing means makes the non-volatile memory unit store the sanitary cleansing data set by the data setting means when the detached state is detected by the attachment state detection means. Since the non-volatile memory unit stores data even at a non-energized time, the sanitary cleansing data set by a user will not be lost and the sanitary cleansing data needs not be set again even if power supply is stopped when a power plug is pulled out by mistake during the operation of detaching the sanitary cleansing apparatus from the toilet bowl.

Still another alternative mode of the invention is direction to the sanitary cleansing apparatus which includes a case main body that is detachable from a toilet bowl and a sanitary cleansing means that is mounted on the case main body to perform sanitary cleansing processes that include at least one of cleansing and drying of the excretory parts of the human body. The sanitary cleansing apparatus includes an attachment state sensor state detection means for detecting a state of attachment of the sanitary cleansing apparatus between an attached state, attached to the toilet bowl, and a detached state, detached from the toilet bowl. A data setting means is provided for setting sanitary cleansing data for said sanitary cleansing means including cleansing water temperature and dryer air temperature, as well as a sanitary cleansing data storing means for storing the sanitary cleansing data in a memory. The cleaning apparatus further includes an update inhibiting means for inhibiting the update of the sanitary cleansing data in the memory of said sanitary cleansing data storing means when the sanitary cleansing apparatus is in the detached state.

In this structure, since the update inhibiting means inhibits the updating of the sanitary cleansing data when the detached state is detected by the attachment state detection means, the sanitary cleansing data will not be updated even with a sanitary cleansing data updating signal output which has been effected by a touch on the operating means by mistake when the sanitary cleansing apparatus is in the detachment state. Therefore, when the sanitary cleansing apparatus is reset to the attached state, the sanitary cleansing processes are performed with the sanitary cleansing data having been set before detachment of the sanitary cleansing apparatus.

The update inhibiting means may have a structure wherein a selective unit for selective inhibition of updating of a plurality of sanitary cleansing data. The selective unit of the update inhibiting means secures the data that are appropriate to the contents of the sanitary cleansing data through selective inhibition of updating of a plurality of sanitary cleansing data. For example, in a case wherein the sanitary cleansing data are a posterior part cleansing command signal and a temperature setting signal, this structure inhibits updating of the temperature setting signal even if the posterior part cleansing signal is updated so as to be disabled with an output of the posterior part cleansing command signal. The setting for spouting of the cleansing water with the posterior part cleansing command signal is thus canceled in the detached state while the spouting of the cleansing water at the same temperature as before the detached state is enabled by inhibition of the updating of the temperature setting signal. These and other objects, features, aspects, and advantages of the present invention will become more apparent from the following detailed description of the preferred embodiments with the accompanying drawings.

DESCRIPTION OF THE PREFERRED EMBODIMENTS

Figure 1:
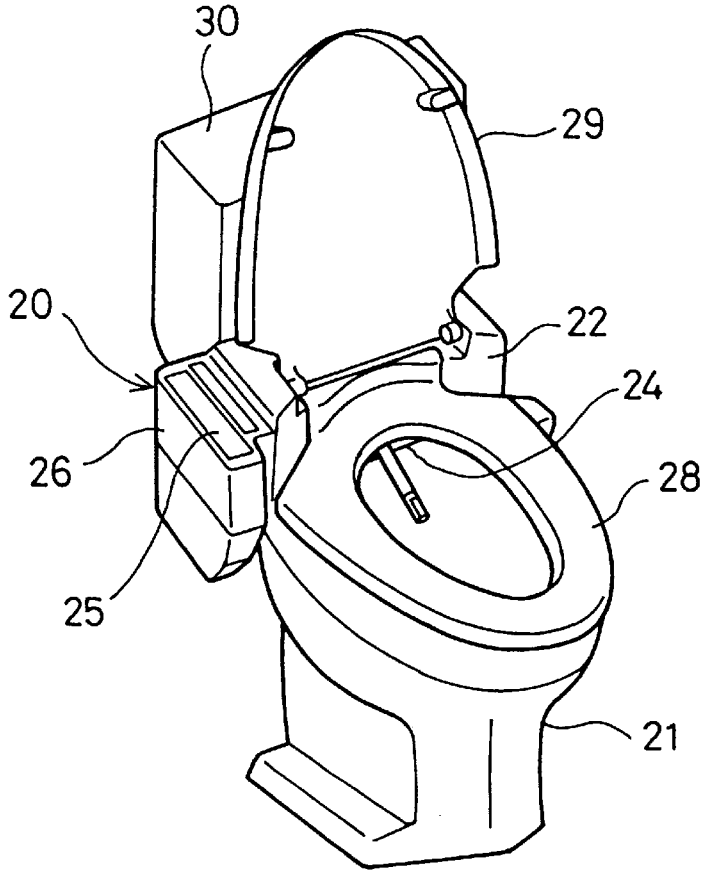
FIG. 1 is a perspective view of a western style toilet bowl with a sanitary cleansing apparatus of an embodiment according to the present invention mounted thereon.
Figure 2:
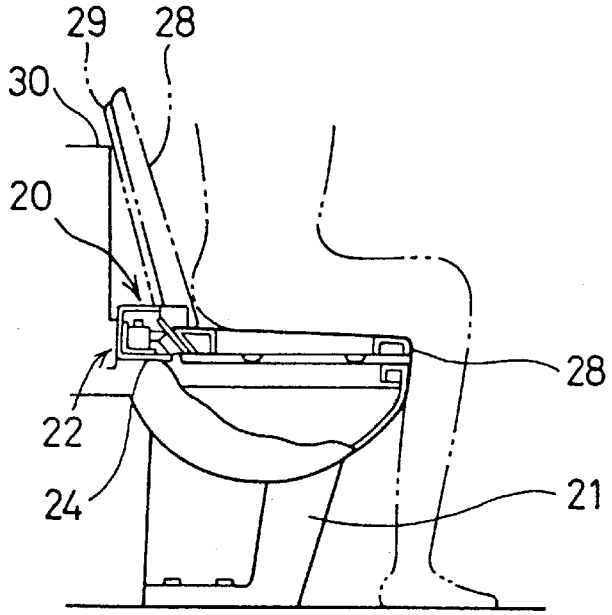
FIG. 2 is an illustrative diagram of the toilet bowl in use.

FIG. 1 is an external view of a western style toilet bowl with an embodiment of a sanitary cleansing apparatus according to the present invention and FIG. 2 is an illustrative diagram of the same in use.

As FIG. 1 and FIG. 2 show, the sanitary cleansing apparatus 20 is to be mounted on the toilet bowl 21, which includes a case main body 22 that stores a unit for heating cleansing water and blowing heated air and that pivotally supports and retains a seat 28 with a shaft not shown in the figures. The cleansing apparatus further includes a shower nozzle 24 for spouting the cleansing water toward the excretory parts of a person seated on the seat 28 to perform sanitary cleansing, and an operation unit 26 which is equipped with an operation panel 25 for operations.

When the sanitary cleansing apparatus 20 is attached to the rear part of the toilet bowl 21, the seat 28 can be lifted and lowered over the toilet bowl 21. In this embodiment, a lid 29 is also pivotally attached to the case main body 22 in the same way as the seat 28 can be lifted and lowered over the toilet bowl 21.

Figure 3:
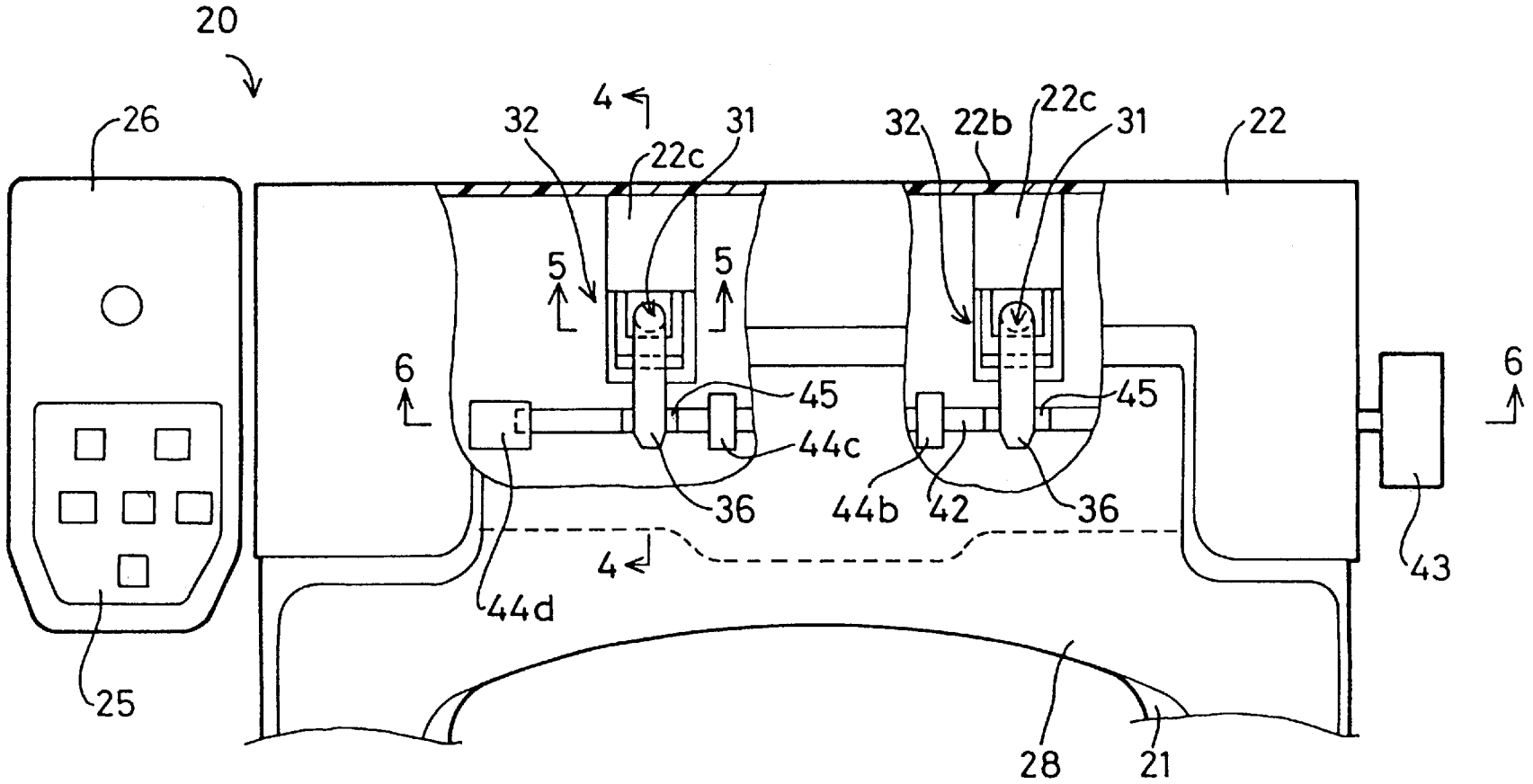
FIG. 3 is a plane figure showing a partial broken-out section of the sanitary cleansing apparatus 20.
Figure 4:
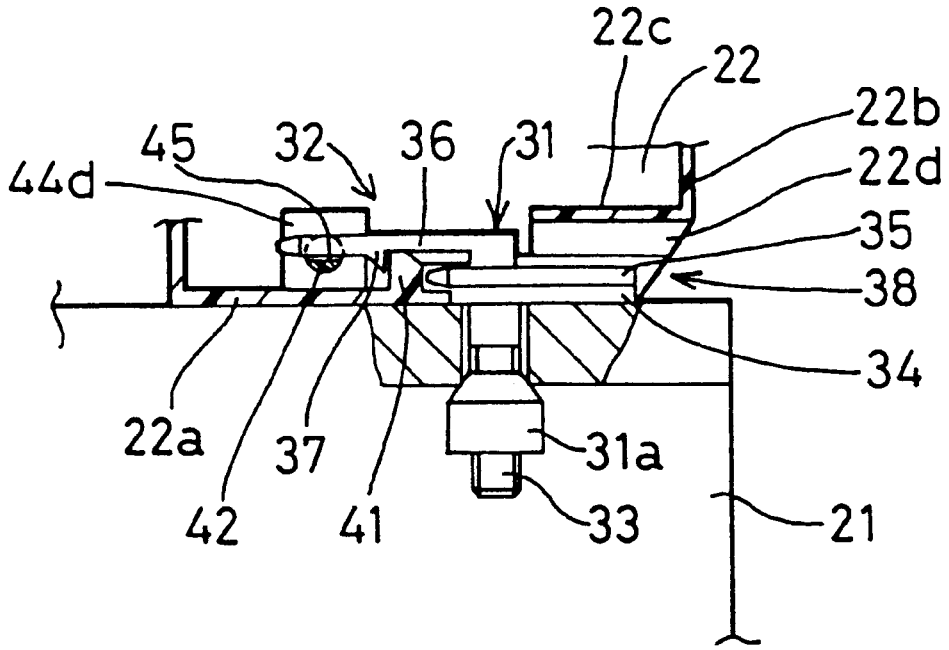
FIG. 4 is a magnified sectional view along line 4—4 in FIG. 3.
Figure 5:
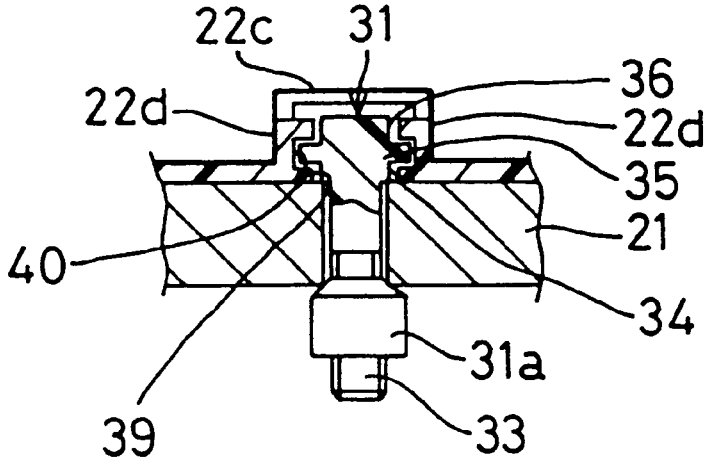
FIG. 5 is a magnified sectional view along line 5—5 in FIG. 3.

The next paragraphs describe the way of attachment and detachment of the case main body 22 to and from the toilet bowl 21 with reference to FIG. 3 which shows a partial broken-out section of the case main body 22, FIG. 4 which shows its magnified sectional view along line 4—4; FIG. 5 which shows its magnified sectional view along line 5—5 and FIG. 6 which shows its magnified sectional view along line 6—6.

As FIG. 3 shows, two fastener insertion cavities 32 for insertion of a fastener 31 for fastening to the toilet bowl 21 are provided in the positions matching the fastener 31. As FIG. 4 shows, each fastener 31 is to be fastened to the toilet bowl 21 by a nut 31*a,* and a toilet bowl grounding plate 34, a guide plate 35 and an engagement plate 36 are provided at the top of a bolt 33. The toilet bowl grounding plate 34 and the guide plate 35 are formed so as to extend from the top of the bolt 33 in the same direction (to the right in FIG. 4) and the engagement plate 36 is formed so as to extend in the opposite direction. The fastener 31 is secured to the toilet bowl 21 by tightening until the toilet bowl grounding plates 34 are grounded on the upper surface of the western toilet bowl 21 with the toilet bowl grounding plates 34 and the guide plates 35 positioned toward the rear of the toilet bowl 21 and the engagement plates 36 positioned toward the front of the toilet bowl 21.

The engagement plate 36 protrudes forward from the upper surface of the toilet bowl 21 in an approximate parallelism to the upper surface with some predetermined clearance, and an engagement projection 37 protrudes downward from the central lower surface. The engagement plate 36 is curved (elastically deformed) with the top part of the bolt 33 as the inflection point so that the predetermined clearance will fluctuate. The guide plate 35 is formed, as FIG. 5 shows, slightly wider than the toilet bowl grounding plate 34.

The fastener insertion cavity 32 in the case main body 22 for insertion of the fastener 31 is formed with a bottom panel 22*a* of the case main body 22, an inner ceiling panel 22*c* which protrudes from a rear side panel 22*b* toward the inside of the case main body 22 and lateral side panels 22*d* on both sides as shown in FIG. 4 and FIG. 5.

A part which is surrounded by the inner ceiling panel 22*c* and both of the lateral side panels 22*d* on the side of the rear side panel 22*b* of the case main body 22, that is, on the rear part of the fastener insertion cavity 32, is an opening 38 for insertion of the fastener 31. Therefore, when the case main body 22 is mounted on a front part of the upper surface of the toilet bowl 21 and slid backward toward the fastener 31, the fastener 31 enters the opening 38 at the rear of the fastener insertion cavity 32 in the case main body 22 with the tip of the engagement plate 36 first.

On both lateral side panels 22*d* at the opening 38 for insertion of the fastener 31, as FIG. 5 shows, grounding plate insertion grooves 39 for fitted insertion of the toilet bowl grounding plate 34 and guide plate insertion grooves 40 for fitted insertion of the guide plate 35 are provided so as to confront each other. Therefore, when the case main body 22 is slid further backward toward the fastener 31, the toilet bowl grounding plate 34 and the guide plate 35 of the fastener 31 fit in the grounding plate insertion grooves 39 and the guide plate insertion grooves 40. Since the plates fit in the grooves, the case main body 22 will not move sideways on the toilet bowl 21 and the rear part of the case main body 22 will not be readily lifted from the upper surface of the toilet bowl 21.

A bevel-end projection 41 protruding upward from an edge of the bottom panel 22*a* is provided at a deep side of the opening 38 of the fastener insertion cavity 32 so as to engage with the engagement projection 37 on the engagement plate 36 of the fastener 31. The front edge (the right-hand edge in FIG. 4) of the bevel-end projection 41 functions as a stopper surface wherewith the tip of the guide plate 35 comes into contact when the fastener 31 is inserted into the fastener insertion cavity 32. When the case main body 22 is slid further backward toward the fastener, the engagement plate 36 of the fastener 31 is curved upward with the top of the bolt 33 as the inflection point since the engagement projection 37, coming into contact with a tapered surface of an edge of the bevel-end projection 41, is lifted while travelling on the tapered surface. When the engagement projection 37 travels beyond the bevel-end projection 41, the engagement plate 36 is reset by resilience and, when the engagement projection 37 engages with the bevel-end projection 41, the tip of the guide plate 35 comes into contact with the front edge of the bevel-end projection 41; thus the case main body 22 is secured to the toilet bowl 21 via the fastener 31. In this state, insertion of the fastener 31 into the fastener insertion cavity 32 is completed.

Figure 6:
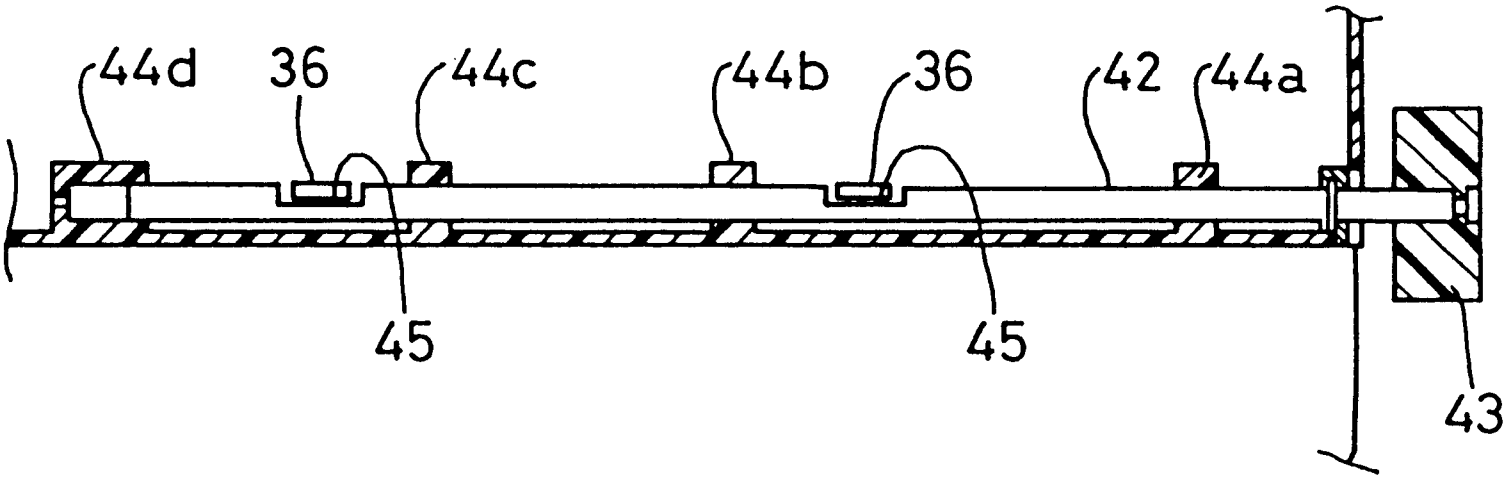
FIG. 6 is a magnified sectional view along line 6—6 in FIG. 3.

Besides the above, a release bar 42 for releasing the above-described engagement of the engagement projection 37 and the bevel-end projection 41 is provided transversely in the case main body 22 as shown in FIG. 3, FIG. 4 and FIG. 6. An end of the release bar 42 protrudes from a lateral side of the case main body 22 and a handle 43 for rotating the release bar 42 is secured on this end. The release bar 42 is supported by four bushings 44*a* through 44*d* (FIG. 6) inside the case main body 22 and is rotatable around the axis. Since the release bar 42 is located in a position where the tips of the engagement plates 36 may interfere with the release bar 42 when the fasteners 31 are fully inserted into the fastener insertion cavities 32, incisions 45 for avoidance of the interference are formed at the interference points.

On one of the four bushings 44*a* through 44*d,* a contact mechanism (not shown in the figures) is provided for temporary retainment of the release bar 42 at a release position when the incisions 45 is positioned upward. The contact mechanism has a structure wherein a spring and a steel ball are assembled inside the bushing so that the steel ball comes out slightly into the through hole while a hole for entrance of the steel ball is formed on the outer cylindrical surface of the release bar 42.

The contact mechanism functions so that the release bar 42 is normally halted with the incisions positioned upward. Therefore, the fastener 31 can be inserted fully into the fastener insertion cavity 32 without hindrance. The case main body 22 is secured to the toilet bowl 21 via the above-described engagement of the engagement projection 37 and the bevel-end projection 41 and via the fastener 31.

This paragraph describes the procedures of detaching the case main body 22 which is secured to the toilet bowl 21. The handle 43 is operated by one hand to rotate the release bar 42. Along with the rotation of the release bar 42 which is made free from interference with the engagement plate 36 by the incisions 45, the release bar 42 curves the engagement plate 36 upward with the top of the bolt 33 as the inflection point. When the engagement plate 36 is curved in this way, the engagement projection 37 is lifted to release the engagement of the engagement projection 37 and the bevel-end projection 41. After the disengagement, the case main body 22 can be removed from the toilet bowl 21 together with the seat 28 in the reverse order of the above-described procedures of attaching the case main body 22. That is, the case main body 22 can be separated from the fastener 31 by a forward slide of the case main body 22 on the upper surface of the toilet bowl 21. After the separation, the seat 28 is removed from the toilet bowl 21 together with the case main body 22 by lifting the case main body 22 together with the seat 28 by both hands.

Whereas the release bar 42 is rotated in the above-described embodiment, the upper surface of the incision 45 may be formed as a slope lifted of the side of the handle 43 so that the engagement of the engagement projection 37 and the bevel-end projection 41 can be disengaged in the same way as the above by pressing the handle 43 to the left in FIG. 3.

As described above, when the seat 28 is removed from the toilet bowl 21 in the toilet seat attachment mechanism of the present embodiment, the seat 28 is easily removed from the toilet bowl 21 together with the case main body 22 by a series of actions consisting of the handle operation for releasing the engagement between the engagement projection 37 and the bevel-end projection 41 and the slide of the case main body 22 toward the front of the toilet bowl 21.

Figure 7:
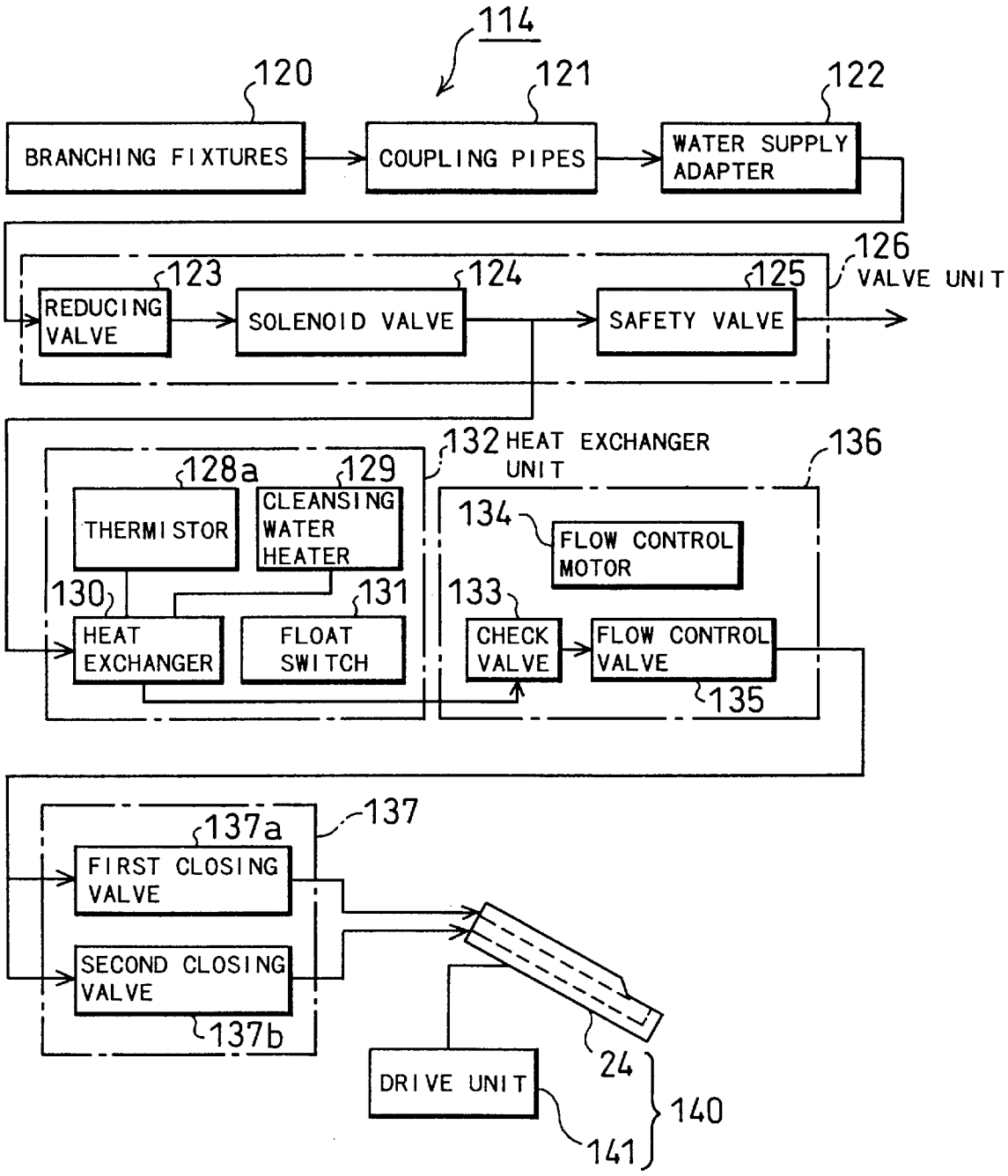
FIG. 7 is a block diagram of the sanitary cleansing apparatus.

The water supply system of the sanitary cleansing apparatus 20 is described below with reference to the block diagram in FIG. 7. As FIG. 7 shows, the external water source is connected by pipeline to supply a flushing water tank and also to supply a sanitary cleansing apparatus 20 through branching fixtures 120 via coupling pipes 121.

The sanitary cleansing apparatus 20 comprises, to start with the upstream side, a valve unit 126 which consists of a water supply adapter 122, a reducing valve 123, a solenoid valve 124 and a safety valve 125, a heat exchanger unit 132 which consists of a heat exchanger 130 that heats up the supplied water to an appropriate temperature with a cleansing water heater 129 while detecting the water temperature with a thermistor 128*a* for warm water and a float switch 131 for detection of presence of water inside the heat exchanger, a flow control unit 136 which consists of a check valve 133 and a flow control valve 135 that is driven by a flow control motor 134 and a closing valve unit 137 which consists of a first closing valve 137*a* and a second closing valve 137*b*, and a nozzle unit 140 is connected at the end. The nozzle unit 140 includes a drive unit 141 for driving the shower nozzle 24 in the axial direction.

Figure 8:
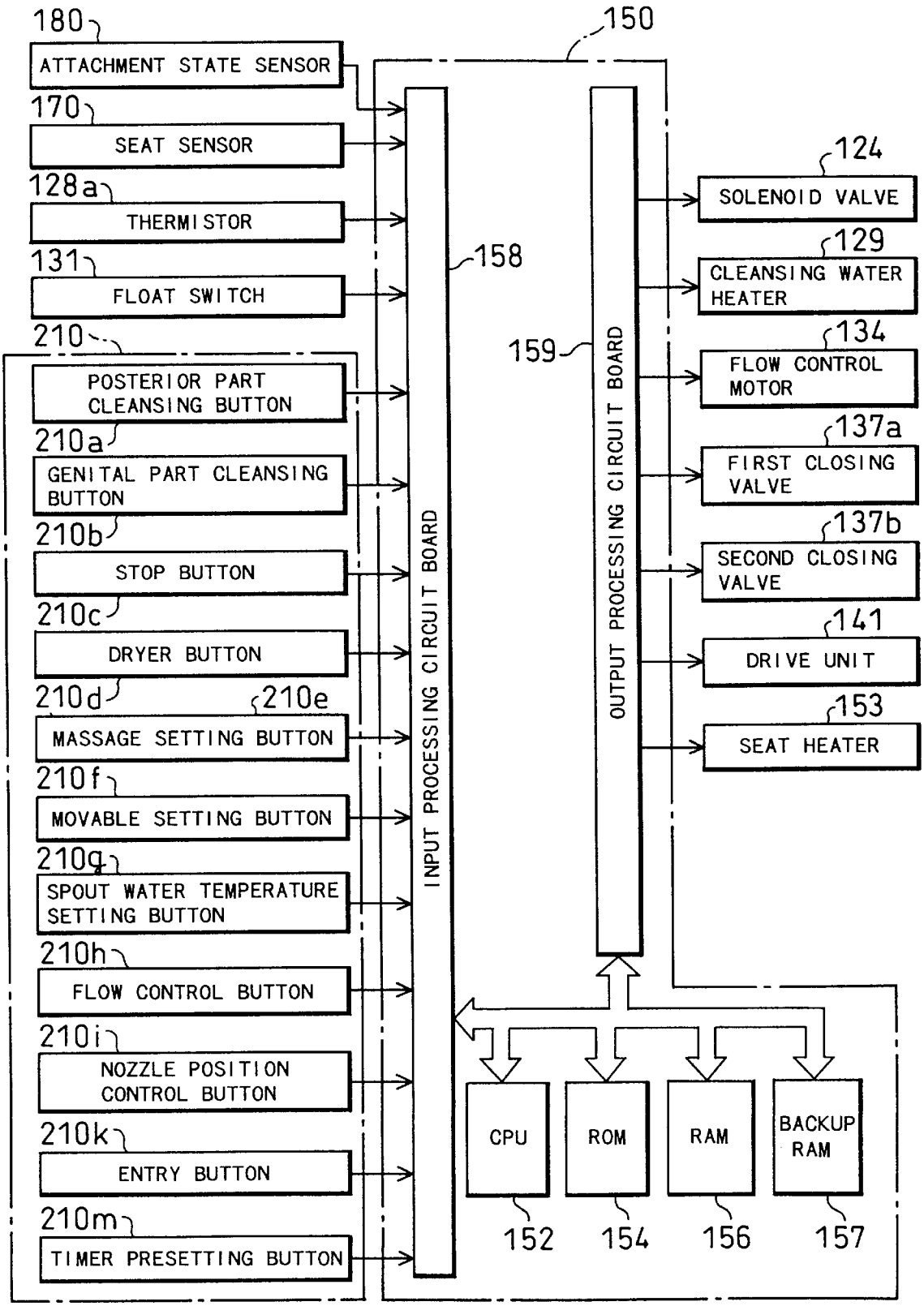
FIG. 8 is a block diagram of the electronic controller 150 incorporated in the sanitary cleansing apparatus 20.

FIG. 8 is a block diagram showing the internal structure of the electronic controller 150 of the sanitary cleansing apparatus 20 and the peripherals thereof. The electronic controller 150 comprises a CPU 152 wherein a variety of computational processing for such a purpose as a cleansing water temperature control based on preset programs are executed, a ROM 154 wherein control programs and control□ data that are necessary for executing the computational processing at the CPU 152 are stored in advance, a RAM 156 wherein data that are necessary for executing the computational processing at the CPU 152 are read and written temporarily, a backup RAM 157 wherein data are retained in memory even if no power is supplied, an input processing circuit board 158 wherein signals from sensors and switches pertaining to the sanitary cleansing apparatus 20 are input and converted into the signals that can be processed by the CPU 152 and an output processing circuit board 159 whereby such as the solenoid valve 124 is driven based on the operational result of the CPU 152. A variety of devices that can be backed up with internal battery, including such a device writable and readable electronically as a flash memory, wherein the data are not erased even if power supply is shut off, may be utilized as the backup RAM 157.

A seat sensor 170 for detection of sitting on the seat 28 is provided on the seat 28. For example, a sensor which detects whether or not a person is on the seat through measurement of transition in the capacitance of a seat heater 153 on the surface of the seat 28 or a pressure sensor may be utilized as the seat sensor 170.

An attachment state sensor 180 for detection of detachment of the sanitary cleansing apparatus 20 from the toilet bowl 21 is provided in the vicinity of the operation unit 26. As in FIG. 9, the attachment state sensor 180 is secured on a printed circuit board P of the sanitary cleansing apparatus 20. The attachment state sensor 180 comprises a pot 182 that is secured on the printed circuit board P, some mercury 183 that is stored in the pot 182, a lid 184 that seals the upper opening of the pot 182, a lead terminal 185 that penetrates the center of the lid 184 and is secured to, a terminal 186*a* that is erected on the printed circuit board P and that is connected to the pot 182, and a terminal 186*b* that is erected on the printed circuit board P and is connected to the lead terminal 185.

In this structure, when the sanitary cleansing apparatus 20 is removed from the toilet bowl 21, the mercury 183 moves inside the pot 182 and makes the circuit between the terminal 186*a* and the terminal 186*b* open to result with an output of a signal on this information. The electronic controller 150 determines the attachment state based on this signal.

As FIG. 8 shows, the electronic controller 150 receives signals from operation buttons 210 on the operation panel 25 on the operation unit 26. The operation buttons 210 includes a variety of buttons which correspond to respective functions; namely, a posterior part cleansing button 210*a*, a genital part cleansing button 210*b*, a stop button 210*c*, a dryer button 210*d* for blowing of warm air, a massage setting button 210*e* for selection of massage cleansing, a movable setting button 210*f* for selection of movable cleansing, a spout water temperature setting button 210*g* for spouting water temperature control, a flow control button 210*h* for flow rate control, a nozzle position control button 210*i* for moving the shower nozzle 24 back and forth, an entry button 210*k* for informing of the completion of attachment after transition of the sanitary cleansing apparatus 20 from the detached state to the attached state and a timer presetting button 210*m* for turning off the seat heater 153 for a predetermined time.

The operations of the units are outlined respectively below. When a user sits on the seat 28 shown in FIG. 1, the seat sensor 170 outputs a signal of this information and then, when the operation panel 25 is operated to press, for example, the posterior part cleansing button 210*a*, the drive unit 141 (FIG. 7). is driven to advance the shower nozzle 24 to the cleansing position as an integral unit and the first closing valve 137*a* of the valve unit 126 is opened to start spouting of the cleansing water. After completion of cleansing, when termination of cleansing is instructed by pressing the stop button 210*c* (FIG. 8) on the operation panel 25, the first closing valve 137*a* is closed to stop spouting of the cleansing water and then the drive unit 141 is turned reverse to retreat the shower nozzle 24 to a storing position.

When the genital cleansing button 210*b* (FIG. 8) is pressed, the shower nozzle 24 (FIG. 1) is advanced to a genital cleansing position and the second closing valve 137*b* is opened to start spouting of the cleansing water while cleansing is terminated by pressing the stop button 210*c*. The seat 28 is provided with the seat heater 153 to maintain the seat surface at an appropriate temperature.

Figure 10:
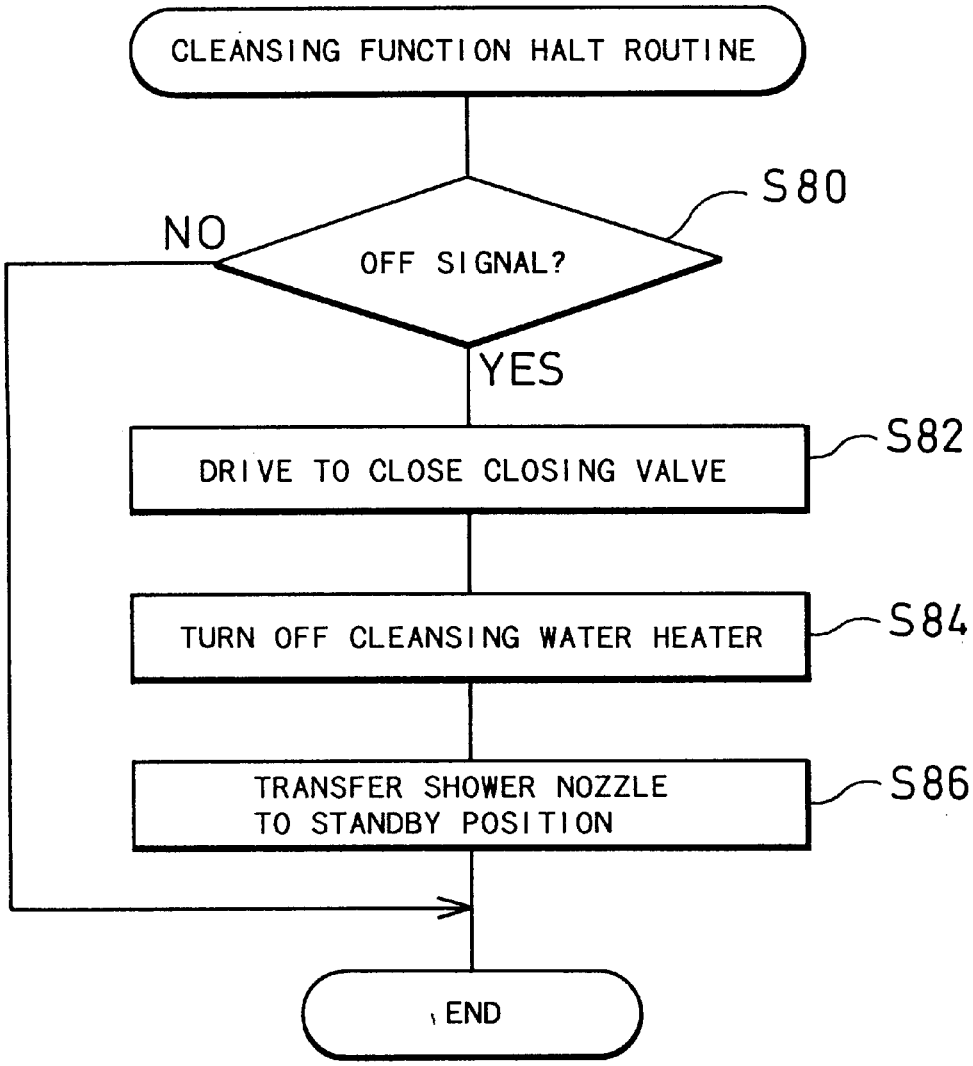
FIG. 10 is a flowchart showing a cleansing function halt routine.

A cleansing function halt routine at the time the sanitary cleansing apparatus 20 is detached from the toilet bowl 21 is described with reference to FIG. 10. FIG. 10 shows a routine which is repetitively executed by the electronic controller 150 on and after turning the power on.

As FIG. 10 shows, whether or not the attachment state sensor 180 has output an off signal to indicate the detached state is determined at step S80. If a negative determination is made at this step, the sequence proceed to the end while, if the off signal is determined to have been output, the sequence proceed to step S82. The first closing valve 137*a* and the second closing valve 137*b* are driven to close at step S82 and the cleansing water heater 129 is turned off at step S84. The drive unit 141 is driven to transfer the shower nozzle 24 to a standby position at step S86 and the drive unit 141 is turned off on completion of the transfer of the shower nozzle 24 to the standby position. The function of the electronic controller 150 for the sanitary cleansing apparatus 20 is recovered by pressing the entry button 210*k* (FIG. 8).

When the cleansing apparatus 20 is detached from the toilet bowl 21 in the above-described processing, the first closing valve 137*a* is closed to shut off water supply even if the shower nozzle 24 is spouting water and power supply to the cleansing water heater 129 is also shut off. This prevents unexpected spouting of water from the shower nozzle 24 and power supply to the cleansing water heater 129 during attaching and detaching operations or in the detached state. Since the shower nozzle 24 is transferred to the standby position, the shower nozzle 24 will not be touched during such an operation as cleaning with the sanitary cleansing apparatus 20 detached and thus no troubles are caused.

As a means for inhibiting the sanitary cleansing processes by the sanitary cleansing function unit, output of signals from the buttons may be disabled or the buttons may be locked to disable the operation itself. In this case, unexpected actions, such as spouting of cleansing water, will not occur even if the operation buttons of the operation unit 26 may be pressed by mistake during operations such as detachment of the sanitary cleansing apparatus 20 from the toilet bowl 21.

Figure 11:
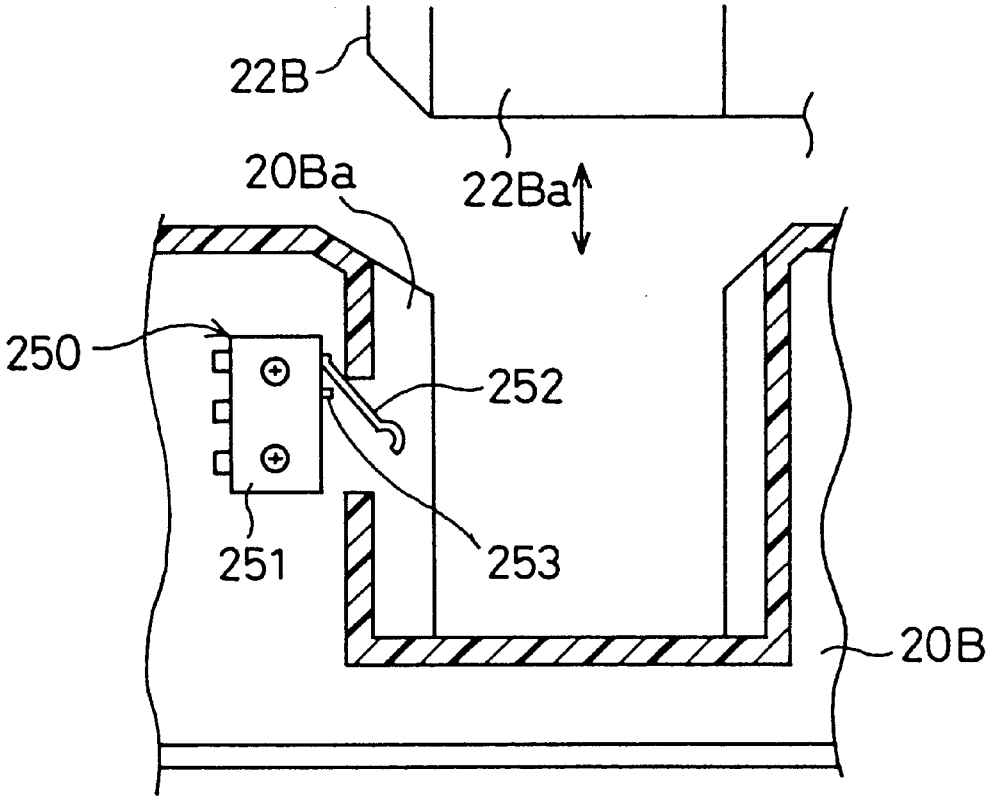
FIG. 11 is a sectional outline of the attachment state sensor 250 related to an alternative embodiment.
Figure 12:
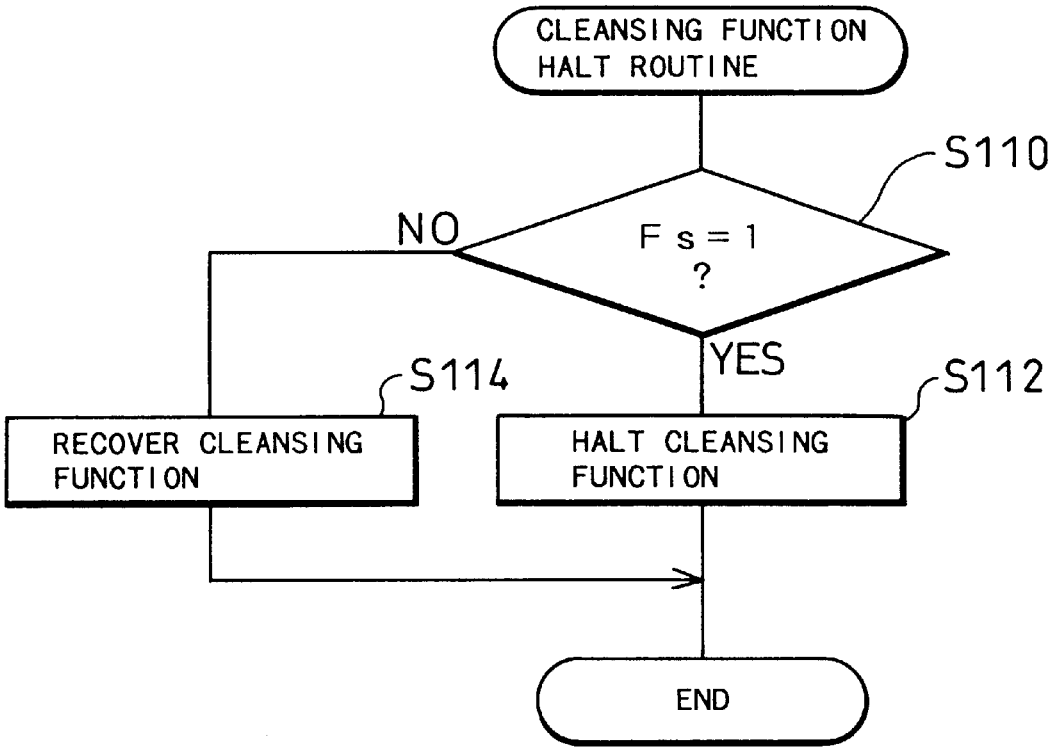
FIG. 12 is a flowchart showing the attaching and detaching routine in the sanitary cleansing processes.
Figure 13:
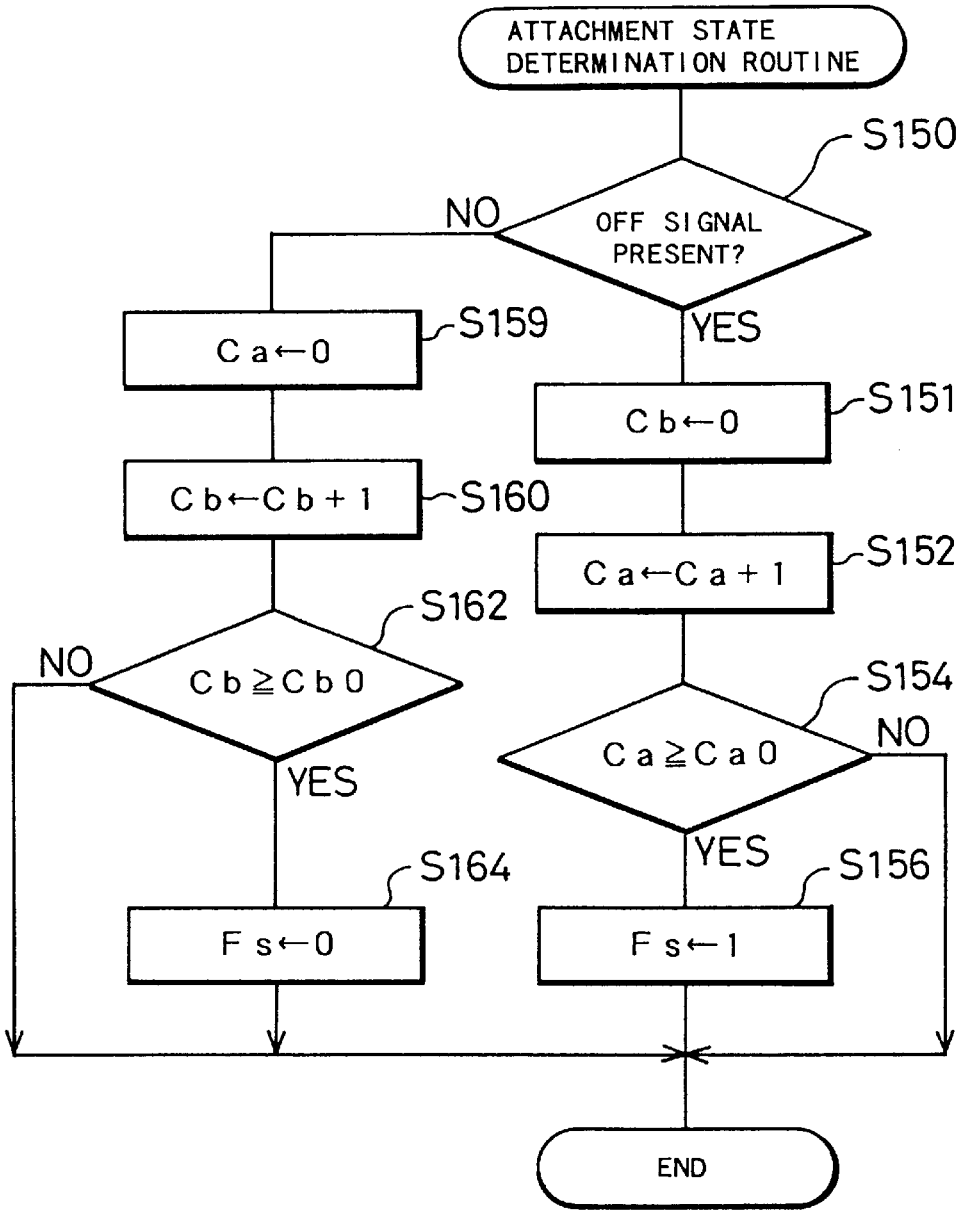
FIG. 13 is a flowchart showing the attachment state determination routine of the sanitary cleansing apparatus 20.

FIG. 11 through FIG. 13 show an alternative embodiment; FIG. 11 is an outline of the attachment state sensor 250; FIG. 12 is a flowchart showing the cleansing function halt routine for the sanitary cleansing apparatus 20; and FIG. 13 is a flowchart showing the attachment state determination routine.

The attachment state sensor 250 in FIG. 11 is described first. The attachment state sensor 250 is a micro switch attached to the inside of a case main body 20B, which comprises a switch main body 251, a movable piece 252 that is supported by a hinge on a surface of the switch main body 251 and a switch knob 253 that will be pressed by the movable piece 252. The attachment state sensor 250 is attached to the inner wall of a guide recess 20Ba in the case main body 20B and an end of the movable piece 252 protrudes into the guide recess 20Ba. In this structure, when the case main body 20B is mounted on the base plate 22B while the guide recess 20Ba is being guided by the guide 22Ba of the base plate 22B that is secured to the toilet bowl (not shown in the figure), the attachment state sensor 250 turns on to output an attached state signal and, when the case main body 20B is detached, a detached state signal is output with the attachment state sensor 250 turned off.

The routines wherein the attachment state sensor 250 is utilized are described now with references to FIG. 12 and FIG. 13. The routine in FIG. 12 executes halt and recovery of the function when the sanitary cleansing apparatus 20 is attached to and detached from the toilet bowl 21. As in FIG. 12, determination of an attachment state flag Fs is executed at step S110. The attachment state flag Fs is set in the routine in FIG. 13 to be "1" when the sanitary cleansing apparatus 20 is detached and to be "0" when attached. The function halt routine is executed at step S112 in the same way as at steps S82 through S86 in FIG. 10 if the attachment state flag Fs is determined as "1" while, if the attachment state flag Fs is determined as "0" at step S110, the sanitary cleansing function recovery routine is executed at step S114. The recovery routine restarts power supply to the seat heater 153, an ozonizer for deodorizing (not shown in the figure□) and other apparatuses.

The routine for setting the attachment state flag Fs which is used at step S110 in FIG. 12 is described below with reference to FIG. 13. As in FIG. 13, whether or not the attachment state sensor 250 has output an OFF signal that is a signal given when the sanitary cleansing apparatus 20 is detached is determined at step S150. If it is determined that the OFF signal has been output at step S150, the sequence proceeds to step S151 and a counter Cb is reset. The counter Cb measures the duration of a continual absence of the OFF signal output.

At the next step S152, a counter Ca is incremented. The counter Ca measures the duration of a continual output of the OFF signal. At step S154, whether or not the measurement at the counter Ca is longer than the predetermined duration of time Ca0 (for example one second) is determined. If it is determined to be negative at step S154, the routine comes to an end for this moment. If it is determined to be longer than the predetermined duration of time Ca0 at step S154, the attachment state flag Fs is set to "1" at step S156. The sanitary cleansing apparatus 20 is determined to have been detached from the toilet bowl 21 with this setting.

If there is no output of the OFF signal from the attachment state sensor 250 at step S150, the counter Ca is reset at step S159 and the counter Cb is incremented at step S160. At step S162, determination on whether or not the measurement at the counter Cb is longer than the predetermined duration of time Cb0 is executed and, if it is determined to be longer than the predetermined duration of time Cb0, the attachment state flag Fs is set to "0" at step S164. This determines that the sanitary cleansing apparatus 20 has been attached to the toilet bowl 21 with this setting.

In the attachment state determination routine in FIG. 13, the detached state is not determined immediately with an output of the OFF signal from the attachment state sensor 250 but determined to be in the detached state only after continuation of the OFF signal for the predetermined duration of time Ca0. Therefore, outputs of frequent alternation between ON and OFF from the attachment state sensor 180 during the operation to detach the sanitary cleansing apparatus 20 will not cause a hunting to repeat inhibition of the functions of the sanitary cleansing apparatus 20 or the recovery routine.

Since this processing requires no operations for recovering the sanitary cleansing function on attaching the sanitary cleansing apparatus 20 to the toilet bowl 21, the operational efficiency is excellent.

Figure 14:
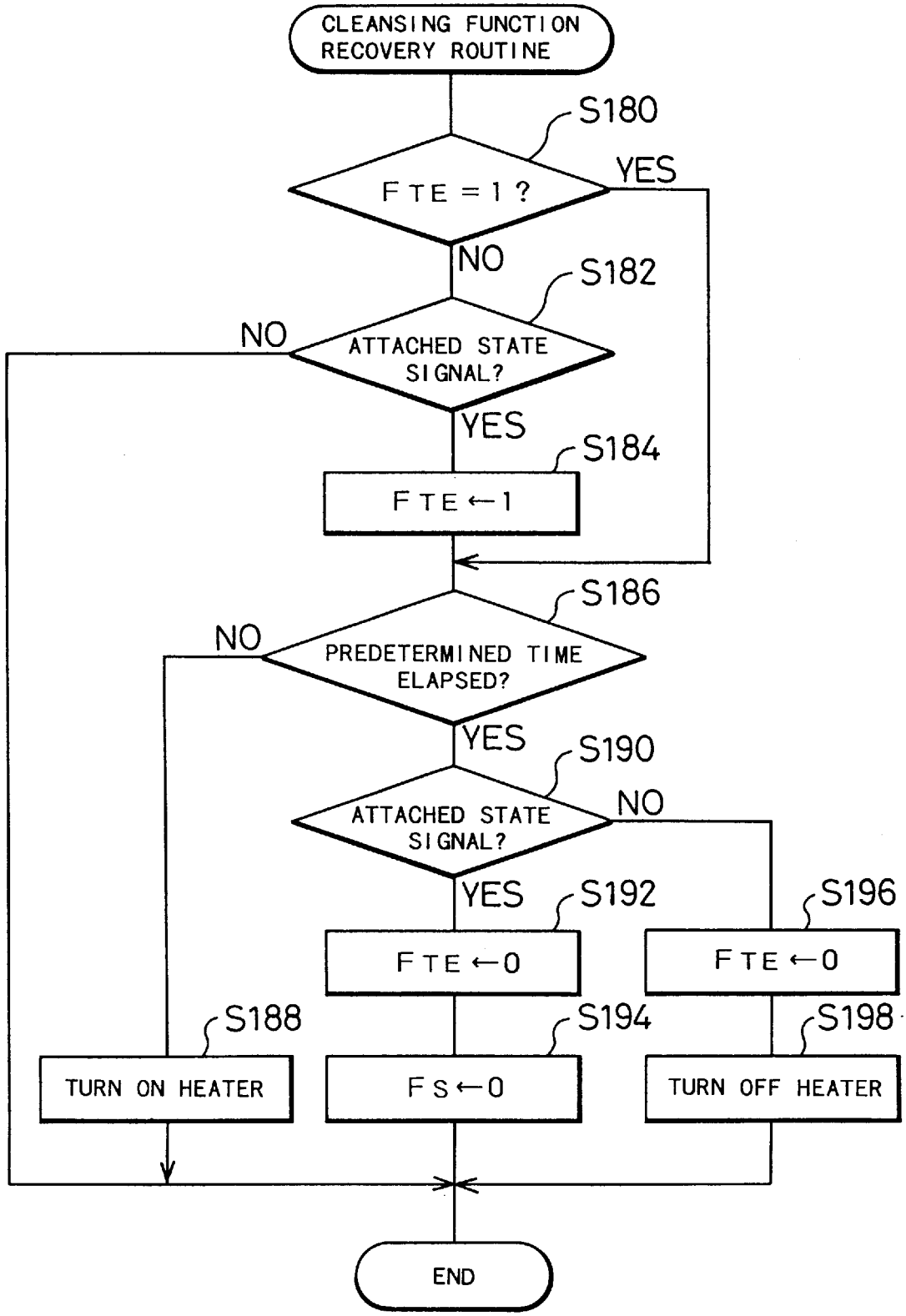
FIG. 14 is a flowchart showing the sanitary cleansing function recovery routine.

Besides the structure wherein all the sanitary cleansing functions are simultaneously recovered on reattachment of the detached sanitary cleansing apparatus 20 to the toilet bowl 21, the recovery may be executed in two steps or more. FIG. 14 shows a flowchart wherein power supply to the cleansing water heater 129 takes precedence on attachment of the sanitary cleansing apparatus 20. As in FIG. 14, determination of a transient attached state flag FTE is executed at step S180. The transient attached state flag FTE is a flag that is set when the sanitary cleansing apparatus 20 is in a transient state of attachment or detachment and that is set to "1" at step 184 if an attached state signal is input from the attachment state sensor 250 at step S182. If the sequence proceeds via Steps S180, S182 and S184, determination on whether or not the predetermined time has elapsed after reception of the attached state signal at step S186. If it is determined that the predetermined time has not elapsed at step S186, the cleansing water heater 129 is turned on at step S188 and the routine comes to an end for this moment. If elapse of the predetermined time is determined at step S186 after determination at step S180 through repetitive processing, whether or not the signal from the attachment state sensor 250 is the attached state signal is determined at step S190. That is, if the attached state signal is determined to be maintained after elapse of the predetermined time after the first reception of the attached state signal from the attachment state sensor 250, the transient attached state flag FTE is reset to "0" at step S192 and the attachment state flag Fs that indicates the attached state is set to "0" at step S194. When the attachment state flag Fs is set to "0", the other sanitary cleansing functions are recovered in other routines. If the attached state signal is not received after elapse of the predetermined time at step S190, the transient attached state flag FTE is reset at step S196 and the cleansing water heater 129 is turned off at step S198.

Even if the attachment state sensor 250 may output unstable signals that are repetitive alternation of the attached state signal and the detached state signal during the attaching or detaching operations, the cleansing water heater 129 that takes longer to heat is given priority in supply of power and warm water can be spouted immediately after attachment of the sanitary cleansing apparatus 20 since the power supply to the cleansing water heater 129 is started in the transient state wherein the attached state signal is output first. The other sanitary cleansing functions are recovered after the attached state is secured for the sanitary cleansing apparatus 20.

The present invention is not restricted to the above embodiments, but there may be many modifications, changes, and alterations without departing from the scope or spirit of the main characteristics of the present invention, for example, as follows:

(1) Whereas the embodiments above have a structure wherein all the sanitary cleansing functions are halted irrelevant to the operations at the operation unit 26, a function to transfer to the standby side may have another possible structure; for example, a function to transfer the shower nozzle 24 to a shunting position may accept the operation at the operation unit 26.

Figure 9:
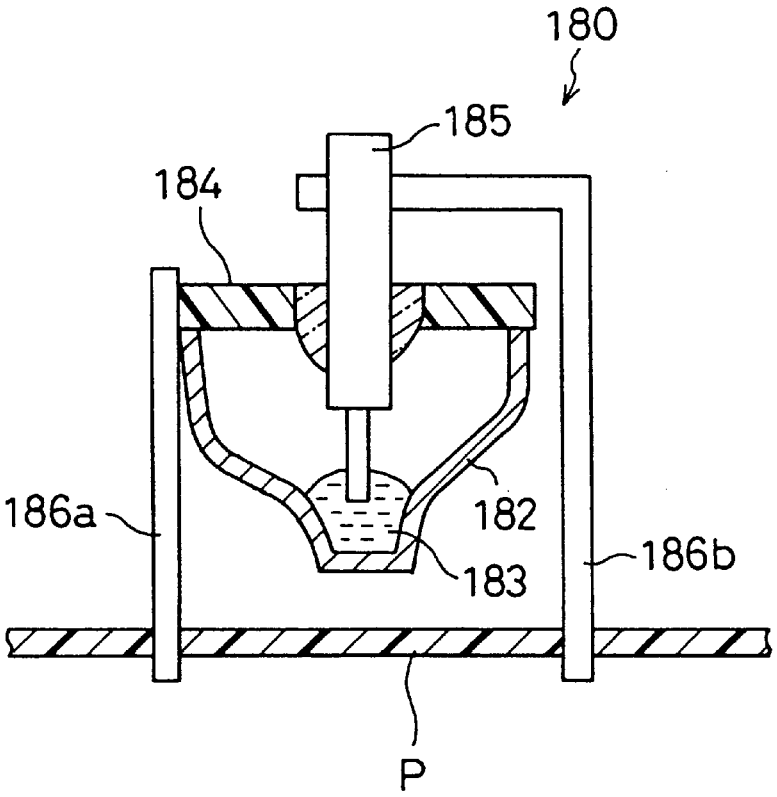
FIG. 9 is a sectional diagram of the attachment state sensor 180.

(2) Whereas the embodiments above have utilizes a tilt switch that is turned off by tilt of mercury as in FIG. 9 or a limit switch as in FIG. 11, without being limited to these, a variety of sensors may be utilized. For example, a sensor utilizing a Hall device or a photoelectric sensor will be applicable.

(3) As a means for recovering the sanitary cleansing functions, besides the above-described means that recovers the functions when the entry button is pressed after the sanitary cleansing apparatus is attached to the toilet bowl, other possible alternatives are a means for recovering when the sanitary cleansing apparatus is attached while a certain button is being pressed or a two-step recovering means for recovering some sanitary cleansing functions when a first button is pressed while the sanitary cleansing apparatus is being attached and recovering all the sanitary cleansing functions when a second button is pressed after the sanitary cleansing apparatus is completely attached.

Figure 15:
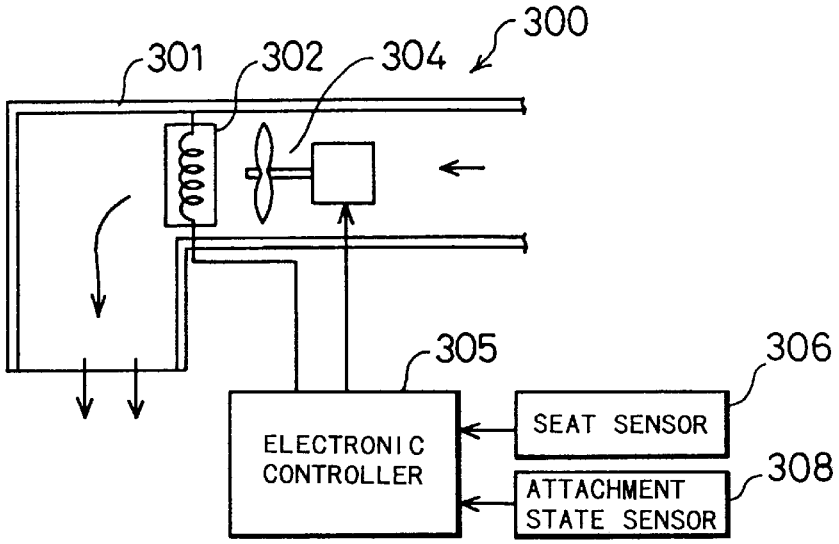
FIG. 15 is a diagram showing the heating unit mounted on the sanitary cleansing apparatus.

The next paragraphs describe the miscellaneous sanitary cleansing functions that are inactivated when the sanitary cleansing apparatus is attached or detached. The first to be described is a room heating unit. When applied to the heating unit, warm air will not blow out even if a hand may come in the way of warm air outlet during attaching and detaching operations. If the following functions are available for the heating unit of this structure, the application will be much more preferable. FIG. 15 is a diagram showing the heating unit 300 and the peripheral circuits mounted on the sanitary cleansing apparatus. In FIG. 15, the heating unit 300 comprises a room heater 302 that is located in a warm air channel 301, a fan 304 for blowing out the warm air heated by the room heater 302 and an electronic controller 305 and has a function that, when sitting of a user is detected by a seat sensor 306, power is supplied to the room heater 302 with the fan 304 being driven to blow out warm air toward the feet of the user whereas the heating is interrupted based on the signals detected by the attachment state sensor 308.

Figure 16:
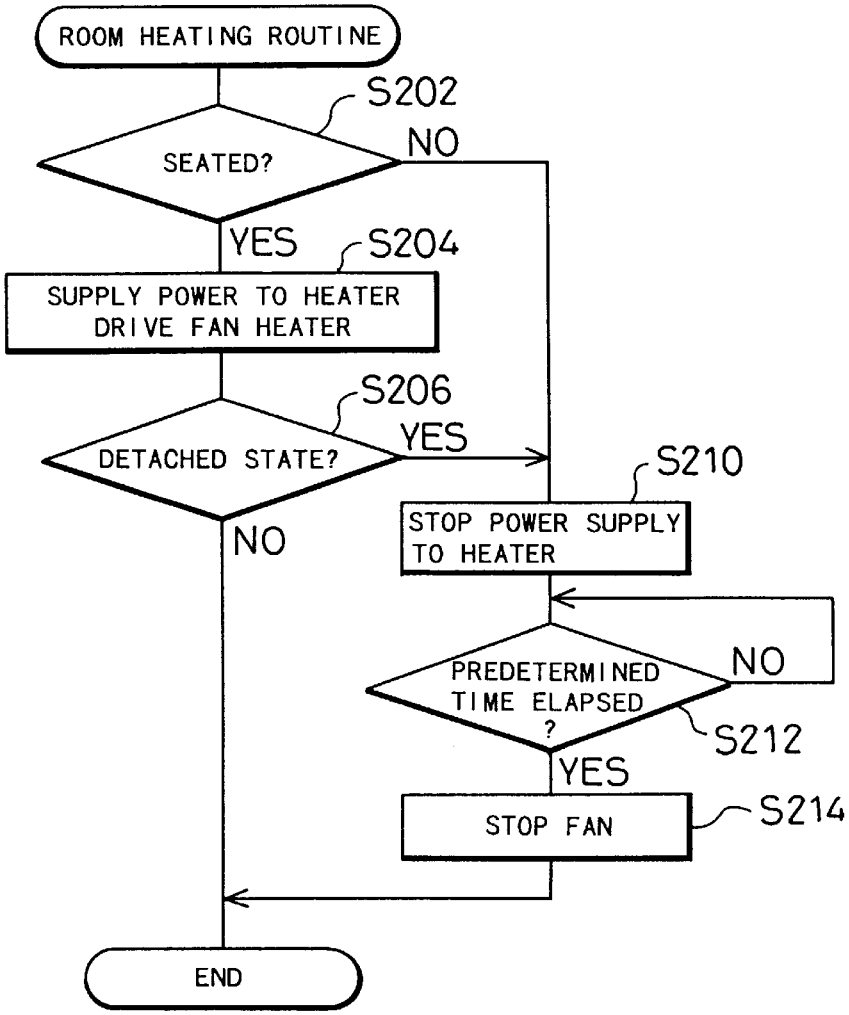
FIG. 16 is a flowchart showing the heating routine.

FIG. 16 is a flowchart showing the processing to drive the heating unit 300 executed by the electronic controller 305. This processing is a routine that is executed when room heating is selected; whether seated state or unseated state is determined first, based on a signal detected by the seat sensor 306 at step S202; if the seated state is determined, power supply t the room heater 302 and drive of the fan 304 are executed at step S204. At step S206, whether attached state or detached state is determined, based on a signal detected by the attachment state sensor 308 at step S202; if the attached state is determined, the sequence comes to the exit of this routine for this moment. If the unseated state is determined on returning to step S202, the sequence proceeds to step S210 where power supply to the room heater 302 is stopped and then, after elapse of a predetermined time at step S212, the fan 214 is stopped at step S304.

If the detached state is determined at step S206, based on the signal detected by the attachment state sensor 308; the sequence proceeds to step S210 and power supply to the room heater 302 is stopped and then, after elapse of a predetermined time, the fan 304 is stopped. The fan 304 is stopped in this way on elapse of the predetermined time after power supply to the room heater 302 is stopped, so that the fan 304 continues to cool the surrounding parts even after power supply to the room heater 302 is stopped to prevent troubles caused by residual heat.

Figure 17:
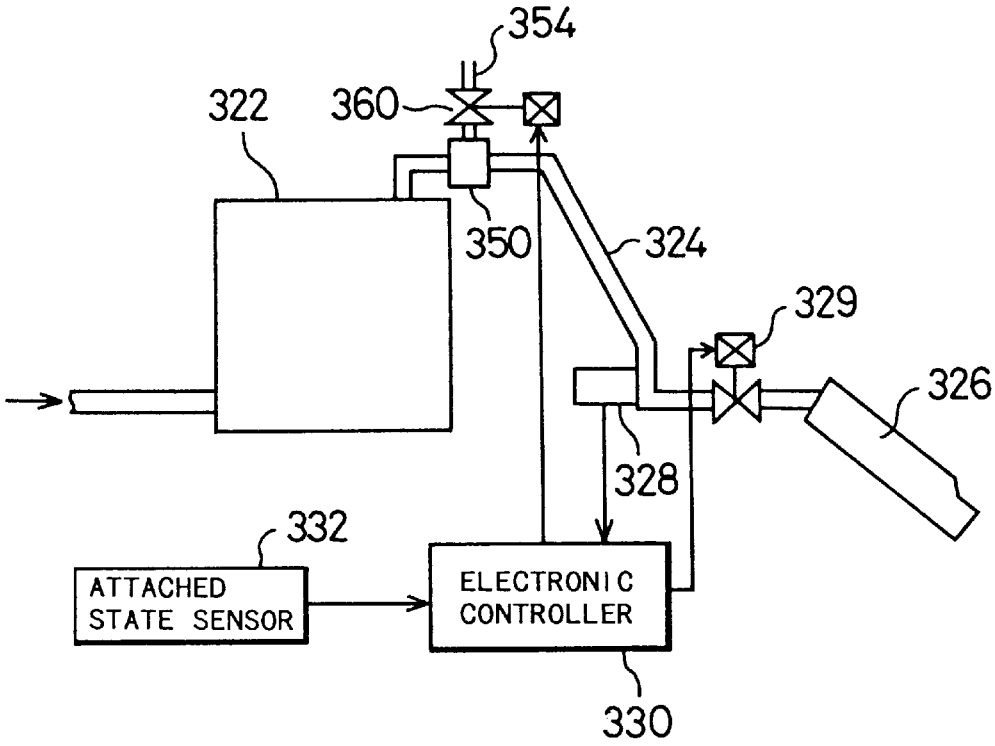
FIG. 17 is a structural diagram showing the spout water channel of the sanitary cleansing apparatus.

This paragraph describes the hot water shutoff unit mounted on the sanitary cleansing apparatus related to an alternative embodiment. FIG. 17 is a structural diagram showing the hot water shutoff unit and the peripherals thereof. The sanitary cleansing apparatus comprises a cleansing water tank 322 that is connected to a water source, a shower nozzle 326 that is supplied with cleansing water heated in the cleansing water tank 322 via a spout water channel 324 and that spouts such cleansing water, a high temperature thermistor 328 that is provided in the spout water channel 324 for detection of temperatures the cleansing water running through the spout water channel 324, a solenoid valve 329 that supplies and shuts off the cleansing water for the shower nozzle 326 and an electronic controller 330. The electronic controller 330 has a hot water shutoff function to inhibit spouting of the cleansing water when the cleansing water is detected to be of a temperature higher than a predetermined temperature according to a detection signal from the high temperature thermistor 328 and executes a processing for locking the hot water shut off function based on the detection signals from the attachment state sensor 332.

Figure 18:
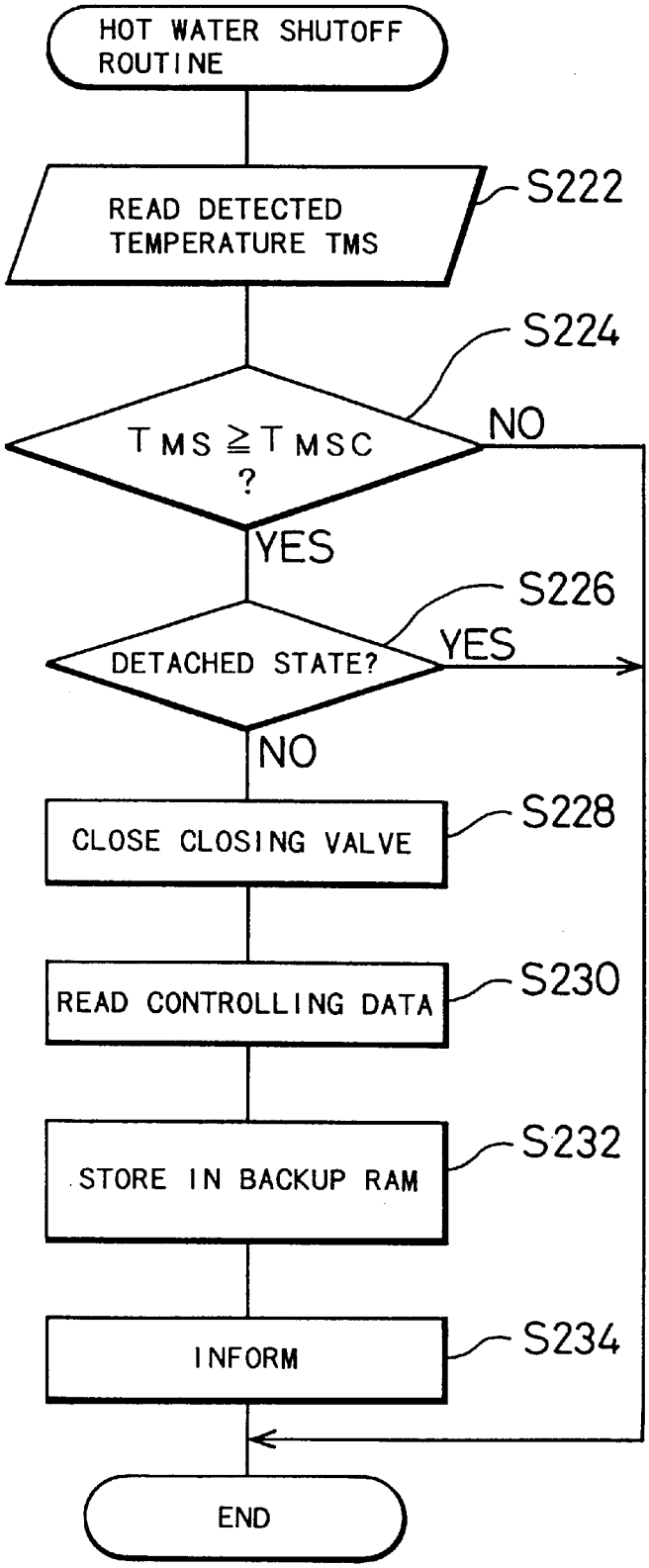
FIG. 18 is a flowchart showing the hot water shutoff routine incorporated in the sanitary cleansing apparatus.

Abnormality determination processing of the electronic controller 330 when the high temperature thermistor 328 has detected temperatures higher than the predetermined temperature is described below with references to the flowchart in FIG. 18. A detected temperature TMs at the high temperature thermistor 328 is read first at step S222. The detected temperature TMs at the high temperature thermistor 328 is determined whether or not equal to or higher than a predetermined temperature TMsc (45° C.) at step S224 and the sequence exits the routine if it is lower than the predetermined temperature TMsc.

If the detected temperature TMs at the high temperature thermistor 328 is determined whether or not equal to or higher than a predetermined temperature at step S224, the attachment state is determined, based on the detection signal from the attachment state sensor 332 at step S226. If the detached state is not determined, the solenoid valve 329 is closed at step S228. This inhibits spouting of hot water of higher than the predetermined temperature from the shower nozzle 326. Other detected data and controlling data of various states that are temporarily stored in the RAM in the electronic controller 330 are read at step S230. The detected data and controlling data include data of signals indicating the operation button settings and sitting state.

At step S232, the information that the detected temperature TMs at the high temperature thermistor 328 is higher than the predetermined temperature is stored in the backup RAM in the electronic controller 330, and the detected data and the controlling data of various states that have been read at step S230 are also stored in the backup RAM. The fact that the temperature higher than the predetermined temperature has been detected is indicated with an indicator lamp and informed at step S234. Since the detected data remains to be stored after recovery of power supply, the water spout inhibition state continues based on this data. When the high temperature thermistor 328 detects the temperature higher than the predetermined temperature in this routine, the information is stored in the backup RAM together with the detected data and controlling data at that time, the fault is quickly discovered at the time of repair.

If the detached state is determined on the basis of the detection signals from the attachment state sensor 332 at step S226, the sequence skips the processing at steps S228 through S234 and exits the routine. Therefore, since the hot water shutoff function is not activated even if hot cleansing water may flow into the spout water channel 324 from the tilted cleansing water tank 322 when the sanitary cleansing apparatus is detached from the toilet bowl, the inherent cleansing function is immediately recovered when the sanitary cleansing apparatus is attached to the toilet bowl without continuation of the water spouting inhibition command by the hot water shutoff function.

Figure 19:
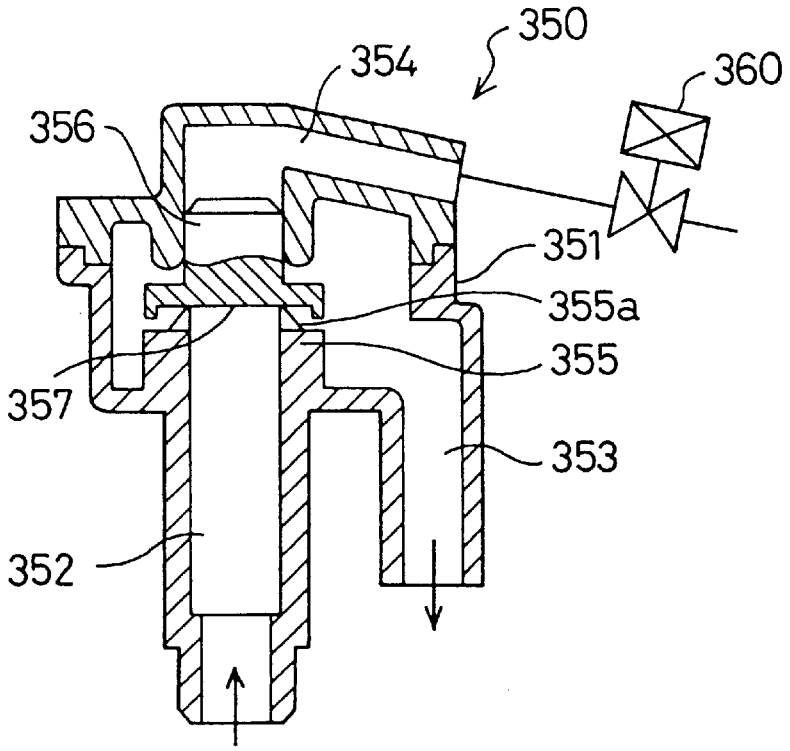
FIG. 19 is a sectional view of the vacuum breaker 350.
Figure 20:
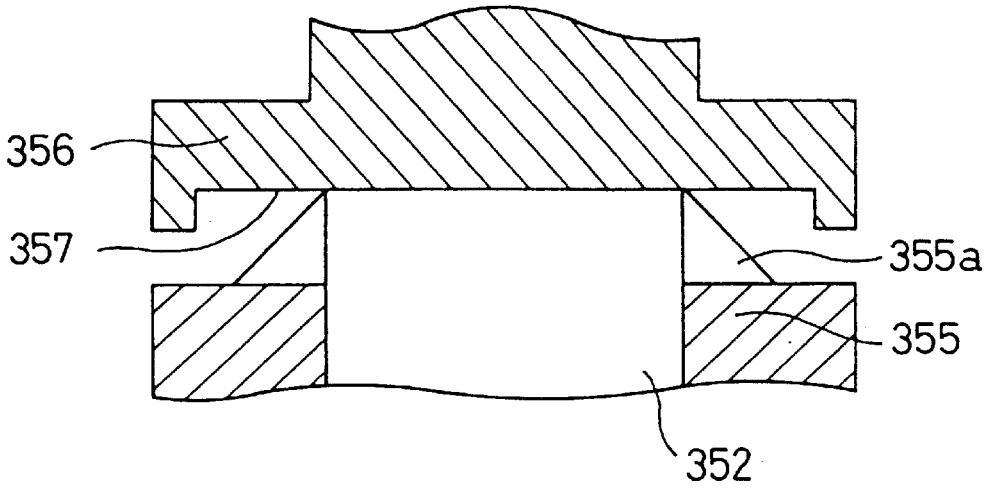
FIG. 20 is a magnified sectional view of the vacuum breaker 350 in the vicinity of the seat part.
Figure 21:
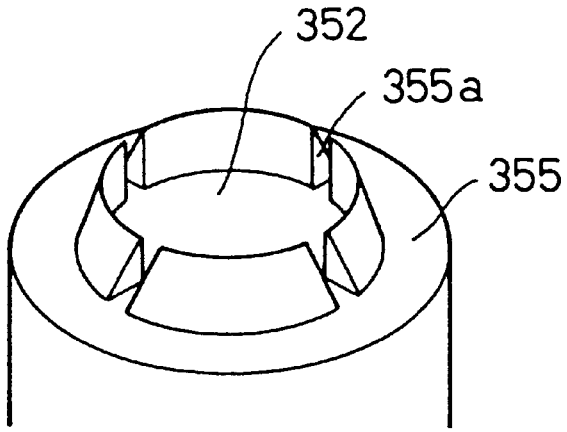
FIG. 21 is a perspective view of the vacuum breaker 350 in the vicinity of the seat part.

An alternative embodiment wherein a vacuum breaker is connected to the cleansing water tank 322 of the sanitary cleansing apparatus is described below. As in FIG. 17, a vacuum breaker 350 is provided on the way of the spout water channel 324 at a position higher than the water level in the cleansing water tank 322. The vacuum breaker 350 comprises a primary side channel 352, a secondary side channel 353 and an atmospheric air intake duct 354 inside the case main body 351 as in FIG. 19. At an opening of the primary side channel 352 in the case main body 351, a seat part 355 is formed so that a base 357 of the valve 356 is seated on it. Four incisions 355*a* for ventilation are formed in the seat part 355 at intervals of 90 degrees in the circumferential direction as in FIG. 20 and FIG. 21.

In this structure of the vacuum breaker 350, hot water from the cleansing water tank 322 presses the valve body 356 via the primary side channel 352; when the force pushing up the valve body 356 becomes large, the valve opens to cope with the empty weight of the valve body 356, and hot water flows from the primary side channel 352 into the secondary side channel 353. When the pressure of the hot water in the primary side channel 352 becomes smaller than the empty weight of the valve body 356, the base 357 is seated on the seat part 355 to close the valve. Since the incisions 355*a* are formed at the seat part 355, air flows into the primary side channel through the incisions 355*a*. This creates an air gap inside the cleansing water tank 322 through the primary side channel 352. Utilizing the air gap, the vacuum breaker 350 prevents counterflow of the water inside a bowl part of the toilet bowl into the cleansing water tank 322 through the shower nozzle 326.

A closing valve 360 is provided in the atmospheric air intake duct 354. The closing valve 360 consists of a solenoid valve which is opened and closed with signals from the electronic controller 330. When the electronic controller 330 determines to be in the detached state, based on the detection signal from the attachment state sensor 308, the closing valve 360 is closed. Therefore, water will not leak even if the cleansing water tank 322 is tilted when the sanitary cleansing apparatus is detached from the toilet bowl.

The next paragraphs describe a processing of another alternative embodiment wherein input values of the operation button settings will not be lost when the sanitary cleansing apparatus is in the detached state.

Figure 22:
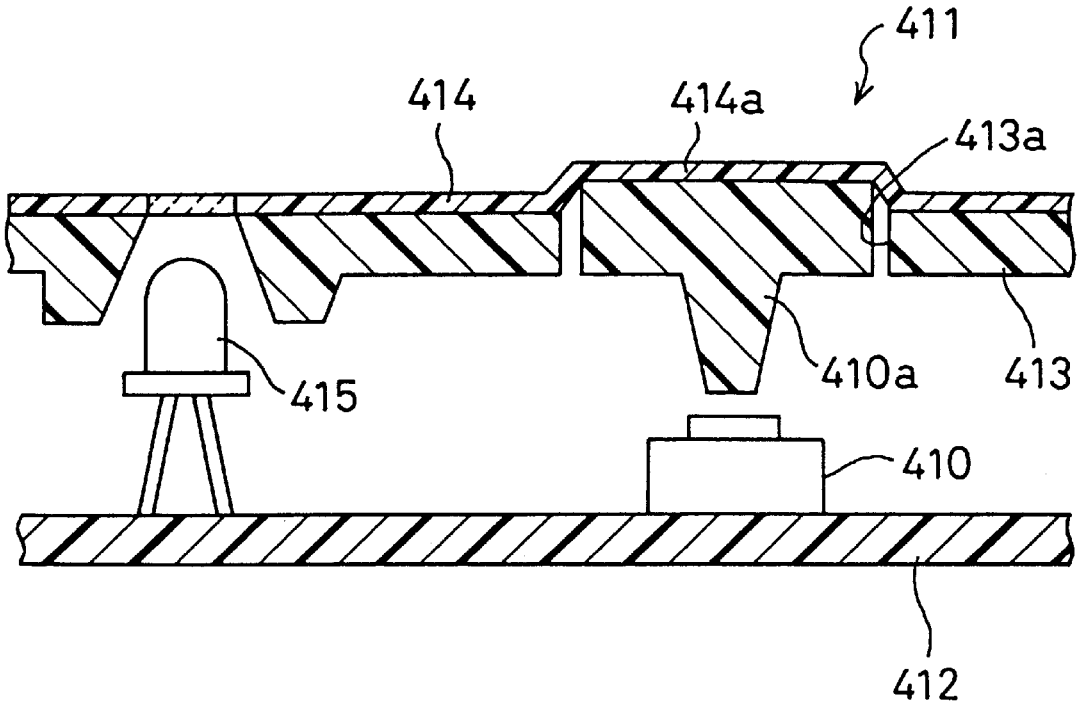
FIG. 22 is a sectional view of the tact switch.

It is preferable that this processing is embodied with utilization of a tactile switch 410 shown in FIG. 22. FIG. 22 is a sectional view showing a switch mechanism 411 which utilizes the tactile switch 410 and the peripherals. The tactile switch 410 is secured on the printed circuit board 412 and a casing 413 is provided above it in parallelism to the printed circuit board 412. Apart of the casing 413 above the tactile switch 410 forms an opening 413*a*, and the opening 413*a* is provided with a key top part 410*a* for operation of the tactile switch 410. The key top part 410*a* is secured to an indication sheet 414 that is stuck to the upper surface of the casing 413. The indication sheet 414 is indicated with a switch operation part 414*a* which shows an operation part of the tactile switch 410. When the switch operation part 414*a* is pressed, the tact switch 410 is operated via the key top part 410*a*. An indicator lamp 415 that turns on and off according to the switching actions at the tactile switch 410 is secured to the printed circuit board 412 on the side proximate to the tactile switch 410. Since the indication sheet 414 is tightly stuck to the casing 413 in the switch mechanism 411 with this structure, leaving no open spaces in the vicinity of the opening 413*a*, the structure is appropriate to the places, such as a toilet, where waterproofing ability is required.

Figure 23:
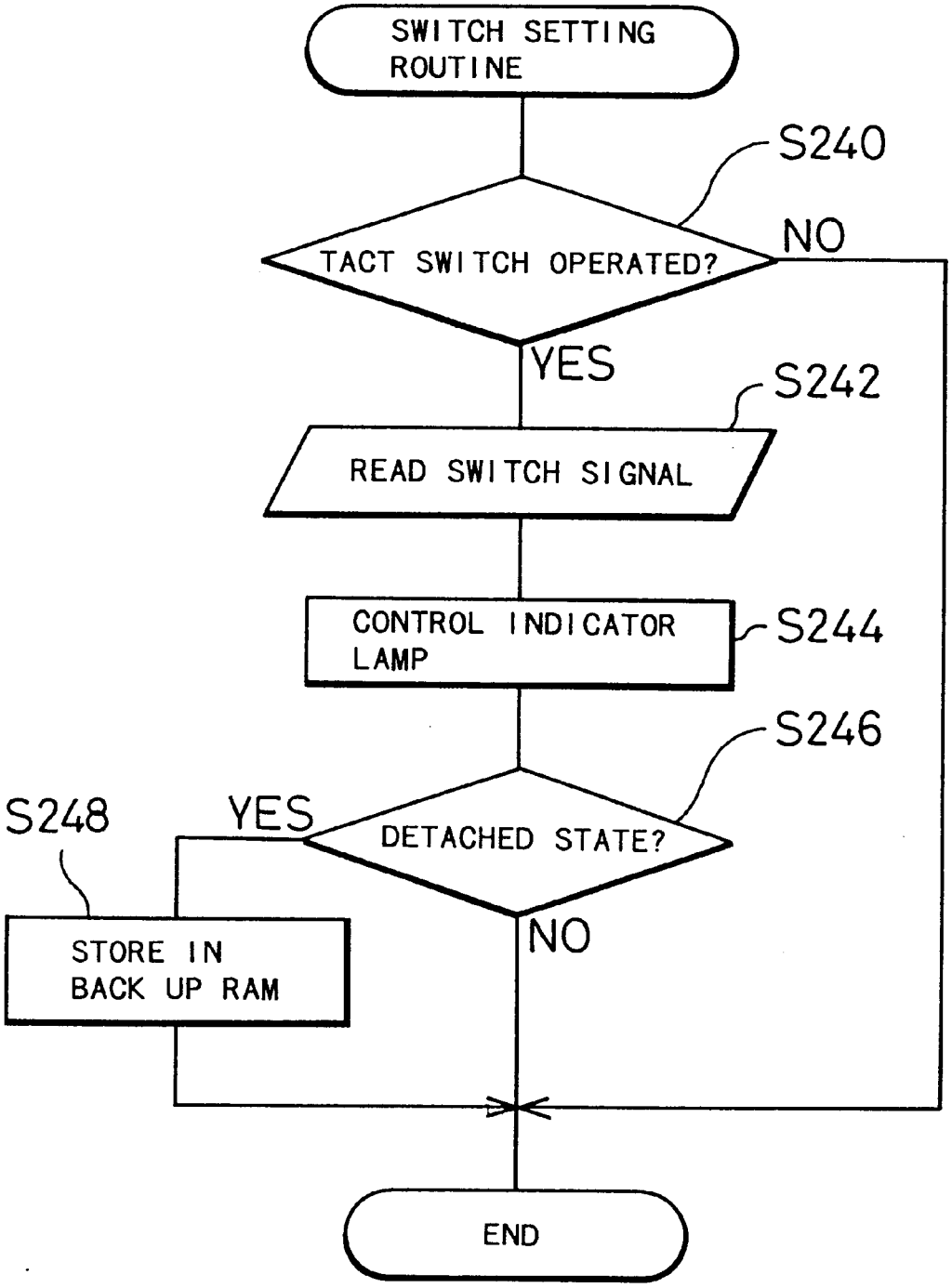
FIG. 23 is a flowchart showing the switch setting routine.

The tactile switch 410 is normally a switch wherein the switch settings are temporary so that the contents of the setting are lost when power supply is stopped, but the present one has a structure wherein the contents are backed up even if power supply is stopped at the time of attaching or detaching the sanitary cleansing apparatus with utilization of a processing in the electronic controller. As a flowchart in FIG. 23 shows, the electronic controller executes an interrupt processing by switching of the tactile switch 410 at step S240 and reads and stores in the RAM the setting at the tactile switch 410 at step S242 to indicate with the indicator lamp 415 at step S244 according to the contents of the setting. If the detached state is determined with the detection signal from the attachment state sensor at step S246, the setting state at the tactile switch 410 is read from the RAM and stored in the backup RAM at step S248.

Therefore, if the detached state is determined based on the detection signal from the attachment state sensor, the contents of setting at the tactile switch 410 is stored in the backup RAM and, since the backup RAM stores sanitary cleansing data even at the time of no power supply, the sanitary cleansing data set by the user will not be lost even if power supply is failed when the power plug is unplugged by mistake during the operation of detaching the sanitary cleansing apparatus from the toilet bowl and there is no need to set the sanitary cleansing data again.

The tactile switch 410 of the sanitary cleansing apparatus can be utilized for various purposes to retain the user setting states; besides the structure of setting for two states, for example, on-off of the seat heater, setting for switching among three states or more, like the spout water temperature setting button, is also available. The switch of spout water temperature is consecutively switching from "Heater Off", "Low Temperature", "Intermediate Temperature", "High Temperature", "Heater Off".

Although the switch utilized in the embodiment described above is the tactile switch, not restricted to this, various types of switches may be utilized. Besides the spout water temperature, the switches may set any variety of data so long as control conditions of the sanitary cleansing apparatus; for example, shower nozzle spout water forces, shower nozzle positions, massage cleansing modes, movable cleansing modes, on-off of the deodorization and on-off of the operation.

The processing of selective cancellation or inhibition of the sanitary cleansing data updating according to the attachment or detachment of the sanitary cleansing apparatus is described below with references to the flowchart in FIG. 24. As in FIG. 24, sanitary cleansing data set by the operation unit is read at step S260 and whether or not in the detached state is determined based on the detection signal from the attachment state sensor at step S262. If it is determined not to be in the detached state in this determination process, the sanitary cleansing data stored in the backup RAM is updated at step S264 to the values set at step S260. This sanitary cleansing data is utilized in other routines, such as processing of the sprouting of cleansing water. If it is determined to be in the detached state at step S262, whether or not the sanitary cleansing data read at step S260 is an ON signal of the stop button at step S266 and, if it is determined to be the ON signal of the stop button, the sequence proceeds to step 264 to update the information that the stop button has been pressed. This executes the shutting off of cleansing water according to the ON signal of the stop button and the transfer of shower nozzle to standby position. If the sanitary cleansing data is determined not to be the ON signal of the stop button at step S266, the routine comes to an end without updating the sanitary cleansing data.

Figure 24:
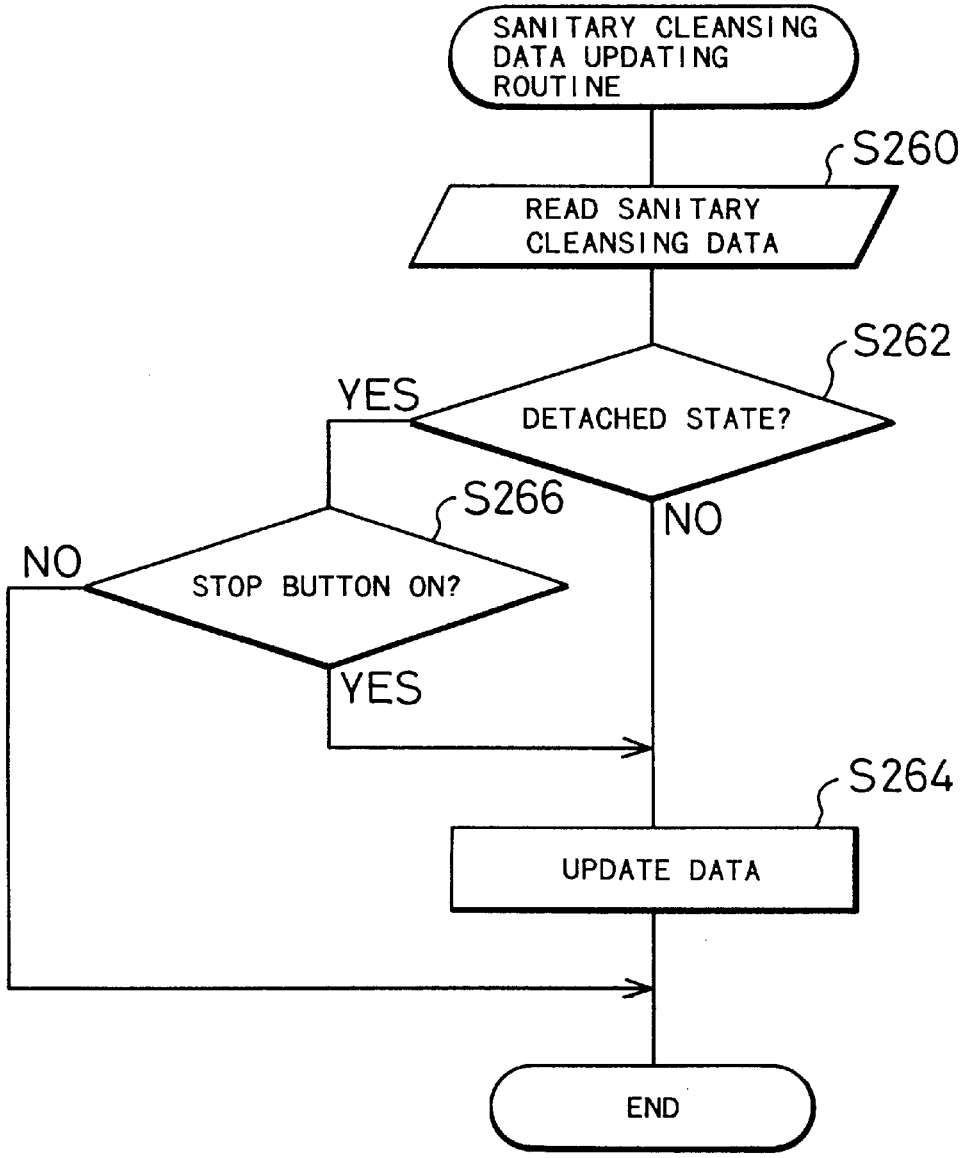
FIG. 24 is a flowchart showing the sanitary cleansing data updating routine.

If the detached state is detected by the attachment state sensor in the routine shown in FIG. 24, the operations on the side of starting the spouting of water in the sanitary cleansing data are canceled and the routine on the safety side is executed; thus, even if the operation unit is touched while the sanitary cleansing apparatus is in the detached state, cleansing water will not be spouted by updating of the sanitary cleansing data.

The sanitary cleansing data having been set at the control unit is updated selectively in the processing in FIG. 24 but, without restriction to this, an alternative processing is to update the sanitary cleansing data stored in the backup RAM selectively to the safety side. For example, if the information that the posterior part cleansing button is turned on is stored in the backup RAM the on state of the posterior part cleansing button may be updated to be the off state if the attachment state sensor has detected the detached state.

What is claimed is:

1. A sanitary cleansing apparatus which includes a case main body that is detachable from a toilet bowl and a sanitary cleansing means that is mounted on said case main body to execute sanitary cleansing processes that includes at least one of cleansing and drying of the excretory parts of the human body, said sanitary cleansing apparatus comprising:

an operating means for output of operational commands;

a sanitary cleansing commanding means for giving commands on proceeding of said sanitary cleansing processes based on the operational commands that are outputs from said operating means to said sanitary cleansing means;

an attachment state of detection means for detecting a state of attachment of said sanitary cleansing apparatus between an attached state, attached to the toilet bowl, and a detached state, detached from the toilet bowl; and an inhibiting means for inhibiting the sanitary cleansing means from said sanitary cleansing processes when the sanitary cleansing apparatus is detected to be in the detached state by said attachment state detection means.

2. A sanitary cleansing apparatus in accordance with claim 1, wherein said attachment state detection means detects states that includes a detached state wherein the sanitary cleansing apparatus is detached from a toilet bowl, an attached state wherein the sanitary cleansing apparatus is attached to the toilet bowl and a transient state during attaching or detaching operation of the toilet bowl and the sanitary cleansing apparatus.

3. A sanitary cleansing apparatus in accordance with claim 1, wherein said attachment state detection means comprises an attachment state signal output unit for output of an attachment state signal when the sanitary cleansing apparatus is attached to or detached from the toilet bowl and an attachment state determination unit for determining whether the attached state or the detached state when the same kind of attachment state signal is output again after elapse of a predetermined duration of time after output of an attachment state signal from said attachment state signal output unit.

4. A sanitary cleansing apparatus in accordance with claim 1, wherein said sanitary cleansing means comprises a standby-and-transition-inclusive function unit wherein a transition from a standby state to a cleansing state executes cleansing or drying of the excretory parts of the human body, and said inhibition means comprises a standby state commanding means for commanding a transition of said standby-and-transition-inclusive function unit to the standby state before inhibiting the sanitary cleansing process command when the attachment state detection means has detected a detached state.

5. A sanitary cleansing apparatus in accordance with claim 4, wherein said standby-and-transition-inclusive function unit is a shower nozzle which reciprocate between the standby state and the cleansing state.

6. A sanitary cleansing apparatus in accordance with claim 4, wherein said standby-and-transition-inclusive function unit comprises a heating means which includes a heater and a fan for sends warm air heated by said heater and a delay means for shutting power supply to said heater off and stopping said fan with some delay from the time of the detached state detection when the attachment state detection means has detected the detached state.

7. A sanitary cleansing apparatus in accordance with claim 4, wherein said inhibition means enables the standby-and-transition-inclusive function unit to transit from the cleansing state to the standby state and to inhibit the other sanitary cleansing processes among the outputs from the operation means.

8. A sanitary cleansing apparatus in accordance with claim 1, wherein said sanitary cleansing means comprises:

a shower nozzle for spouting heated cleansing water supplied through a spout water conduit;

a temperature detection means that is provided in said spout water conduit for detection of the temperatures of the cleansing water flowing through said spout water conduit; and a hot water shutoff means that has a hot water shutoff function to inhibit spouting of cleansing water when the temperature of the cleansing water has been detected to be higher than a predetermined temperature based on the detection signal from said temperature detection means; and said inhibition means comprises a hot water shutoff lock means for locking the hot water shutoff function of said hot water shutoff means when the attachment state detection means has detected the detached state.

9. A sanitary cleansing apparatus in accordance with claim 1, wherein said sanitary cleansing means comprises:

a cleansing water tank wherein heated cleansing water is stored;

a spout water conduit which is connected to said cleansing water tank;

a shower nozzle for spouting cleansing water from said cleansing water tank via said spout water conduit;

an intake air duct which is connected to said spout water conduit and which opens said spout water conduit to the atmospheric air; and a vacuum breaker for preventing counterflow from the shower nozzle to said cleansing water tank by valve operations between an open valve position to open said intake air duct to the atmospheric air and a closed valve position to close said intake air duct while the cleansing water is flowing from said cleansing water tank; and that said inhibiting means comprises a closing valve to open and close said intake air duct and a closing valve control means for forcibly closing said closing valve when the detached state is detected by the attachment state detection means.

10. A sanitary cleansing apparatus in accordance with claim 1, which comprises a cancellation means for canceling the inhibition command on the sanitary cleansing processes when said attachment state detection means has detected the attached state.

11. A sanitary cleansing apparatus in accordance with claim 10, wherein said sanitary cleansing means comprises a flow control valve for controlling of the rate of flow to the shower nozzle, and said cancellation means cancels the inhibition command on the sanitary cleansing processes and prepares for the next sanitary cleansing process through setting said flow control valve to a state to spout at a desired flow rate.

12. A sanitary cleansing apparatus in accordance with claim 10, wherein said cancellation means cancels the inhibition command to the sanitary cleansing means in two steps.

13. A sanitary cleansing apparatus in accordance with claim 12, wherein said sanitary cleansing means is a water temperature control means for heating the cleansing and said cancellation means cancels the inhibition command on the heating of sanitary cleansing water on the first step.

14. A sanitary cleansing apparatus comprising a case main body that is detachable from a toilet bowl and a sanitary cleansing means that is mounted on said case main body to perform sanitary cleansing processes that includes at least one of cleansing and drying of the excretory parts of the human body on transition from a standby state to a cleansing state, said sanitary cleansing apparatus comprising:

an operating means for output of operational commands;

a sanitary cleansing commanding means for giving commands on proceeding of said sanitary cleansing processes based on the operational commands that are outputs from said operating means to said sanitary cleansing means;

an attachment state detection means for detecting either a transient detached state, wherein said sanitary cleansing apparatus is on a process of detachment from said toilet bowl, or a detached state; and a standby state commanding means for outputting a command to shift said sanitary cleansing means from the cleansing state to said standby state when one of the transient detached state and the detached state is detected by said attachment state detection means.

15. A sanitary cleansing apparatus comprising a case main body that is detachable from a toilet bowl and a sanitary cleansing means that is mounted on said case main body to perform sanitary cleansing processes that include at least one of cleansing and drying of the excretory parts of the human body, said sanitary cleansing apparatus comprising:

an attachment state of detection means for detecting a state of attachment of the sanitary cleansing apparatus between an attached state, attached to the toilet bowl, and a detached state, detached from the toilet bowl;

a data setting means for setting sanitary cleansing data for the sanitary cleansing means including cleansing water temperature and drying air temperature; and a sanitary cleansing data storing means which includes a non-volatile memory unit for storing data even at a non-energized time and a memory command unit for making said non-volatile memory unit store the sanitary cleansing data by said data setting means when the detached state is detected by said attachment state detection means.

16. A sanitary cleansing apparatus comprising a case main body that is detachable from a toilet bowl and a sanitary cleansing means that is mounted on said case main body to perform sanitary cleansing processes that include at least one of cleansing and drying of the excretory parts of the human body, said sanitary cleansing apparatus comprising:

an attachment state detection means for detecting a state of attachment of said sanitary cleansing apparatus between an attached state, attached to the toilet bowl, and a detached state, detached from the toilet bowl;

a data setting means for setting sanitary cleansing data for said sanitary cleansing means including cleansing water temperature and dryer air temperature;

a sanitary cleansing data storing means for storing the sanitary cleansing data in a memory; and an update inhibiting means for inhibiting the update of the sanitary cleansing data in the memory of said sanitary cleansing data storing means when the sanitary cleansing apparatus is in the detached state.

17. A sanitary cleansing apparatus in accordance with claim 16, wherein said update inhibiting means has further comprises a selective unit for selective inhibition of updating of a plurality of sanitary cleansing data.

18. A sanitary cleansing apparatus for a toilet bowl comprising:

a case main body detachably mounted to the toilet bowl;

a cleansing mechanism coupled to said main body and adapted to execute sanitary cleansing processes on the human body;

a detection mechanism configured to detect a state of attachment of said sanitary cleansing apparatus between an attached state, attached to the toilet bowl, and a detached state, detached from the toilet bowl; and an inhibiting mechanism configured to inhibit the cleansing mechanism from executing said cleansing processes when the detection mechanism detects the sanitary cleansing apparatus to be in the detached state.

19. The sanitary cleansing apparatus in accordance with claim 18 wherein, said detection mechanism is further adapted to detect a transient state during the attaching or detaching operation of the sanitary cleansing apparatus to and from the toilet bowl.

20. A sanitary cleansing apparatus in accordance with claim 18 wherein, said detection mechanism further includes:

an attachment state signal output unit configured to output an attachment state first signal when the sanitary cleansing apparatus is attached to the toilet bowl, and output an attachment state second signal when the sanitary cleansing apparatus is detached from the toilet, and an attachment state determination unit for determining whether the cleansing apparatus is in the attached state or the detached state when one of the first signal and the second signal is output again after elapse of a predetermined duration of time after the initial output of one of the first signal and the second signal, respectively, from said attachment state signal output unit.

21. A sanitary cleansing apparatus in accordance with claim 18 wherein, said cleansing mechanism further includes a standby-and-transition-inclusive function unit wherein a transition from a standby state to a cleansing state executes one of cleansing and drying of the excretory parts of the human body, and said inhibition mechanism includes a standby state commanding device adapted to command a transition of said standby-and-transition-inclusive function unit to the standby state before inhibiting the sanitary cleansing process command when the detection mechanism has detected a detached state.

22. A sanitary cleansing apparatus in accordance with claim 18 further including:

a cancellation mechanism adapted to canceling the inhibition command on the sanitary cleansing processes when said attachment state detection means has detected the attached state.

23. A sanitary cleansing apparatus in accordance with claim 18 further including:

an operating mechanism adapted to output operational commands; and a sanitary cleansing commanding mechanism adapted to output commands to execute said sanitary cleansing processes based on the operational commands that are outputs from said operating mechanism to said cleansing mechanism.

24. A sanitary cleansing apparatus for a toilet bowl comprising:

a case main body detachably mounted to the toilet bowl;

a cleansing mechanism coupled to said main body and adapted to execute sanitary cleansing processes on the human body on transition from a standby state to a cleansing state;

a detection mechanism configured to detect either a transient detached state, during the process of detachment of said sanitary cleansing apparatus from said toilet bowl, or a detached state; and a standby state commanding mechanism configured to output a command to shift said cleansing mechanism from the cleansing state to the standby state when one of the transient detached state and the detached state is detected by said detection mechanism.

25. A sanitary cleansing apparatus for a toilet bowl comprising:

a case main body detachably mounted to the toilet bowl;

a cleansing mechanism coupled to said main body and adapted to perform sanitary cleansing processes on the human body;

a detection mechanism configured to detect a state of attachment of said sanitary cleansing apparatus between an attached state, attached to the toilet bowl, and a detached state, detached from the toilet bowl; and a data setting device adapted to set cleansing data for the cleansing mechanism; and a data storage device adapted to store the cleansing data by said data setting device when the detached state is detected by said detection mechanism.

* * * * *